US009999895B2

(12) United States Patent
Nelson et al.

(10) Patent No.: US 9,999,895 B2
(45) Date of Patent: Jun. 19, 2018

(54) SPRAY INSERTS

(71) Applicant: S.C. Johnson & Son, Inc., Racine, WI (US)

(72) Inventors: Cory J. Nelson, Racine, WI (US); Harbinder S. Pordal, Mason, OH (US)

(73) Assignee: S. C. Johnson & Son, Inc., Racine, WI (US)

( * ) Notice: Subject to any disclaimer, the term of this patent is extended or adjusted under 35 U.S.C. 154(b) by 227 days.

(21) Appl. No.: 14/815,026

(22) Filed: Jul. 31, 2015

(65) Prior Publication Data

US 2016/0039596 A1 Feb. 11, 2016

Related U.S. Application Data

(60) Provisional application No. 62/034,081, filed on Aug. 6, 2014.

(51) Int. Cl.

| | |
|---|---|
| ***B05B 1/34*** | (2006.01) |
| ***B65D 83/28*** | (2006.01) |
| *B65D 83/20* | (2006.01) |

(52) U.S. Cl.

CPC ..... *B05B 1/3426* (2013.01); *B05B 1/34* (2013.01); *B05B 1/3415* (2013.01); *B05B 1/3436* (2013.01); *B65D 83/28* (2013.01); *B65D 83/206* (2013.01)

(58) Field of Classification Search

CPC ..... B05B 1/341; B05B 1/3415; B05B 1/3426; B05B 1/3431; B05B 1/3436; B65D 83/28

See application file for complete search history.

(56) References Cited

U.S. PATENT DOCUMENTS

| | | | | |
|---|---|---|---|---|
| 3,112,074 A | | 11/1963 | Green | |
| 3,129,893 A | | 4/1964 | Green | |
| 3,226,040 A | | 12/1965 | Briechle et al. | |
| 3,406,911 A | | 10/1968 | Keeney | |
| 3,416,737 A | | 12/1968 | Venus | |
| 3,437,270 A | | 4/1969 | Venus | |
| 3,785,571 A | * | 1/1974 | Hoening | B65D 83/20 239/337 |
| 3,881,658 A | | 5/1975 | Greenebaum, II et al. | |
| 3,994,442 A | | 11/1976 | Hoening | |
| 4,056,213 A | | 11/1977 | Stern | |

(Continued)

FOREIGN PATENT DOCUMENTS

| | | |
|---|---|---|
| EP | 0991477 B1 | 4/2003 |
| EP | 1610045 A1 | 12/2005 |

(Continued)

OTHER PUBLICATIONS

International Search report and Written Opinion issued in corresponding PCT Application No. PCT/US2015/043061, dated Feb. 7, 2017, 6 pages.

(Continued)

*Primary Examiner* — Ryan A Reis

(57) ABSTRACT

According to a first aspect, a spray insert includes a sidewall and a first vane extending from the sidewall. The spray insert also includes an endwall including a discharge outlet. The spray insert further includes a first boss including a tip and a side to direct a fluid product toward a swirl chamber. The boss is disposed on the endwall and extends from the vane. The side has a point of inflection.

20 Claims, 12 Drawing Sheets

(56) References Cited

U.S. PATENT DOCUMENTS

| | | | | |
|---|---|---|---|---|
| 4,071,196 | A | 1/1978 | Burke et al. | |
| 4,322,037 | A | 3/1982 | Heeb et al. | |
| 4,979,678 | A | 12/1990 | Ruscitti et al. | |
| 5,110,052 | A | 5/1992 | Graf et al. | |
| 5,337,926 | A | 8/1994 | Drobish et al. | |
| 5,411,185 | A | 5/1995 | Drobish | |
| 5,540,389 | A | 7/1996 | Knickerbocker | |
| 5,547,132 | A | 8/1996 | Grogan | |
| 5,676,311 | A | 10/1997 | Hartman | |
| 5,711,488 | A | 1/1998 | Lund | |
| 5,738,282 | A | 4/1998 | Grogan | |
| 5,769,325 | A | 6/1998 | Jouillat et al. | |
| 5,934,569 | A | 8/1999 | Soule et al. | |
| 5,992,765 | A | 11/1999 | Smith | |
| 6,000,633 | A | 12/1999 | Lund et al. | |
| 6,142,390 | A | 11/2000 | Nordstrom et al. | |
| 6,193,172 | B1 | 2/2001 | Soule et al. | |
| 6,199,766 | B1 | 3/2001 | Fox et al. | |
| 6,241,165 | B1 | 6/2001 | Bickart et al. | |
| 6,279,834 | B1 | 8/2001 | Fox et al. | |
| 6,341,735 | B1 | 1/2002 | Baudin | |
| 6,398,082 | B2 | 6/2002 | Clark et al. | |
| 6,418,925 | B1 | 7/2002 | Genova et al. | |
| 6,482,357 | B1 | 11/2002 | Fox et al. | |
| 6,533,196 | B1 | 3/2003 | Ouin et al. | |
| 6,543,703 | B2 | 4/2003 | Blake | |
| 6,592,813 | B1 | 7/2003 | Fox et al. | |
| 6,609,666 | B1 | 8/2003 | Blake | |
| 6,612,510 | B1 | 9/2003 | Fox et al. | |
| 7,143,959 | B2 | 12/2006 | Smith et al. | |
| RE39,767 | E | 8/2007 | Soule et al. | |
| 7,370,815 | B2 | 5/2008 | Fecht et al. | |
| 7,694,895 | B2 | 4/2010 | Bougamont et al. | |
| 7,708,949 | B2 | 5/2010 | Stone et al. | |
| 7,748,648 | B2 | 7/2010 | Songbe et al. | |
| 7,757,905 | B2 | 7/2010 | Strand et al. | |
| RE41,864 | E | 10/2010 | Soule et al. | |
| 7,828,231 | B2 | 11/2010 | Harms | |
| 7,886,995 | B2 * | 2/2011 | Togashi | B05B 1/341 222/321.8 |
| 7,938,342 | B2 | 5/2011 | Octeau et al. | |
| 8,191,801 | B2 | 6/2012 | Khan et al. | |
| 8,191,802 | B2 | 6/2012 | Khan et al. | |
| 8,196,847 | B2 | 6/2012 | Helie et al. | |
| 8,276,835 | B2 | 10/2012 | Lowry et al. | |
| 8,322,630 | B2 | 12/2012 | Richardson et al. | |
| 8,322,631 | B2 | 12/2012 | Richardson et al. | |
| 8,333,332 | B2 | 12/2012 | Burghaus et al. | |
| 8,337,778 | B2 | 12/2012 | Stone et al. | |
| D674,078 | S | 1/2013 | Marin | |
| 8,517,227 | B2 | 8/2013 | Strand et al. | |
| 8,690,081 | B2 | 4/2014 | Cornet et al. | |
| 8,807,457 | B2 | 8/2014 | Songbe | |
| 2002/0008119 | A1 | 1/2002 | Clark et al. | |
| 2005/0133628 | A1 | 6/2005 | Fecht et al. | |
| 2005/0172476 | A1 | 8/2005 | Stone et al. | |
| 2005/0224608 | A1 | 10/2005 | Khan et al. | |
| 2005/0236497 | A1 | 10/2005 | Bougamont et al. | |
| 2006/0226265 | A1 * | 10/2006 | Miller | B01J 4/002 239/585.1 |
| 2007/0039979 | A1 | 2/2007 | Strand et al. | |
| 2007/0057091 | A1 | 3/2007 | Burghaus et al. | |
| 2008/0061165 | A1 | 3/2008 | Songbe et al. | |
| 2008/0067262 | A1 | 3/2008 | Varanasi et al. | |
| 2008/0230633 | A1 | 9/2008 | Harms | |
| 2009/0078785 | A1 | 3/2009 | Herminghaus | |
| 2010/0155432 | A1 * | 6/2010 | Christianson | B05B 1/3436 222/402.1 |
| 2010/0172803 | A1 | 7/2010 | Stone et al. | |
| 2010/0264167 | A1 | 10/2010 | Strand et al. | |
| 2011/0248099 | A1 | 10/2011 | Ghavami-Nasr et al. | |
| 2011/0272493 | A1 | 11/2011 | Richardson et al. | |
| 2011/0303766 | A1 | 12/2011 | Smith | |
| 2011/0303767 | A1 | 12/2011 | Smith | |
| 2011/0303768 | A1 | 12/2011 | Cornet et al. | |
| 2012/0018539 | A1 | 1/2012 | Horiuchi et al. | |
| 2012/0037668 | A1 | 2/2012 | Bicknell et al. | |
| 2012/0205466 | A1 | 8/2012 | Baltz et al. | |
| 2012/0217322 | A1 | 8/2012 | Songbe | |
| 2012/0234935 | A1 | 9/2012 | Sun | |
| 2012/0234947 | A1 | 9/2012 | Takahashi | |
| 2013/0008540 | A1 * | 1/2013 | Shah | A61L 9/14 137/808 |
| 2013/0037634 | A1 | 2/2013 | Miller et al. | |
| 2013/0119157 | A1 | 5/2013 | Alluigi | |
| 2014/0037514 | A1 | 2/2014 | Stone et al. | |
| 2014/0145009 | A1 | 5/2014 | Hartranft et al. | |

FOREIGN PATENT DOCUMENTS

| | | | | |
|---|---|---|---|---|
| EP | 1900437 | A1 | 3/2008 | |
| EP | 1916033 | | 4/2008 | |
| GB | 2248888 | A | 4/1992 | |
| WO | 03061839 | | 7/2003 | |
| WO | WO 03061839 | A1 * | 7/2003 | B05B 1/3436 |
| WO | WO2010052168 | A1 | 5/2010 | |

OTHER PUBLICATIONS

International Search Report and Written Opinion issued in corresponding PCT Application No. PCT/US2015/043061, dated Jun. 11, 2015, 8 pages.

* cited by examiner

SPRAY INSERTS

CROSS REFERENCE TO RELATED APPLICATIONS

This application claims the benefit of U.S. Provisional Application No. 62/034,081, which was filed on Aug. 6, 2014 and entitled "Spray Inserts." U.S. Provisional Application No. 62/034,081 is incorporated by reference herein in its entirety.

REFERENCE REGARDING FEDERALLY SPONSORED RESEARCH OR DEVELOPMENT

Not Applicable

SEQUENCE LISTING

Not applicable.

BACKGROUND OF THE DISCLOSURE

1. Field of the Disclosure

The present disclosure relates to emanation systems, and in particular, to spray inserts.

2. Description of the Background of the Disclosure

Traditional emanation systems often include an aerosol canister having a valve stem. An overcap assembly may be coupled to the aerosol canister, which includes an actuator such as a button or trigger that is actuated by a user to activate the valve stem and dispense a fluid from the aerosol canister. The dispensed fluid is directed through a fluid pathway within the overcap assembly and is dispensed through a nozzle into the ambient environment. It is common for such nozzles to include a spray insert to effect the spray pattern of the dispensed fluid. However, many prior art emanation systems suffer from irregular or undesirable spray characteristics. Such irregular or undesirable spray characteristics are commonly found in compressed gas aerosol canisters, which undergo a pressure drop over the life of the canister that may adversely impact the spray characteristics of the fluid. A need therefore exists for providing an emanation system that can provide desirable spray characteristics when used with aerosol canisters. Further, a need also exists to provide such spray characteristics with emanation systems that use compressed gas aerosol canisters.

SUMMARY

According to a first aspect, a spray insert includes a sidewall and an endwall including a discharge outlet. The spray insert also includes a first baffle disposed on the sidewall and a second baffle disposed on the sidewall. The second baffle is spaced apart from the first baffle to define a first longitudinal channel to direct a fluid product into a lateral channel. The spray insert further includes a first boss disposed on the endwall and extending from the first baffle to define a portion of the lateral channel. The first boss has a tip spaced apart from the discharge outlet, and the first boss includes an airfoil-shaped portion to direct the fluid product in the lateral channel into a swirl chamber.

According to another aspect, a spray insert includes a sidewall and an endwall including a discharge outlet. The spray insert also includes a first baffle disposed on the sidewall and a first boss disposed on the endwall to direct fluid product into a swirl chamber. The first boss extends from the first baffle. The first boss includes a rounded tip, a first side portion, and a second side portion opposite the first side portion. The first side portion has a first radius of curvature and a first arc length, and the second side portion has a second radius of curvature and a second arc length. The first radius of curvature is greater than the second radius of curvature, and the first arc length is longer than the second arc length.

According to another aspect, a spray insert includes a sidewall and a first vane extending from the sidewall. The spray insert also includes an endwall including a discharge outlet. The spray insert further includes a first boss including a tip and a side to direct a fluid product toward a swirl chamber. The boss is disposed on the endwall and extends from the vane. The side has a point of inflection.

According to another aspect, a spray insert includes a swirl chamber defined by a plurality of curved bosses and an interior surface of an end wall of the spray insert. The spray insert also includes an outlet bore in communication with and downstream of the swirl chamber. The bosses rotate a fluid product flowing through the swirl chamber to enable the spray insert to discharge a sheet of the fluid product. The sheet of the fluid product includes an air core extending from an outlet aperture of the outlet bore to about eight inches from the outlet aperture along a central, longitudinal axis of the outlet bore when the fluid product is supplied to the spray insert at a pressure between about 30 pounds per square inch to about 135 pounds per square inch.

According to another aspect, a spray insert includes a swirl chamber and an outlet bore in communication with and downstream of the swirl chamber. The swirl chamber includes a plurality of bosses to rotate a fluid product dispensed from a substantially full aerosol canister into the spray insert to discharge a sheet of the fluid product via the outlet bore. The sheet has an inner boundary and an outer boundary, and between about 50% and about 97% of the fluid product discharged via the outlet bore is disposed within a volume defined between the inner boundary and the outer boundary for a distance of about eight inches from a discharge aperture of the outlet bore. An angle from a longitudinal axis extending through a center of the outlet bore to an inner diameter of an annular spray pattern formed on a substantially planar surface disposed the distance of about eight inches from the discharge aperture is between about 21 degrees and about 38 degrees.

According to a different aspect, a spray insert includes a boss having a first side and a second side. The first side is curved about a first axis of curvature offset from and parallel to a central, longitudinal axis of the spray insert. The second side is curved about a second axis of curvature offset from and parallel to the first axis of curvature and the central, longitudinal axis of the spray insert. The first side and the second side direct a fluid product along a first curved channel and a second curved channel, respectively, and into a swirl chamber. The spray insert also includes a bore having a substantially constant cross-sectional area. The outlet bore receives the fluid product from the swirl chamber and discharges the fluid product from the spray insert as a sheet. The sheet forms a substantially annular spray pattern having an outer diameter of between about 5.5 inches and about 7.5 inches on a substantially planar surface when the fluid is discharged from the spray insert about eight inches away from the planar surface.

According to another aspect, an aerosol system includes an aerosol canister employing compressed gas to supply a fluid product at a pressure between about 30 pounds per square inch to about 135 pounds per square inch. The fluid product has a viscosity of about 2.4173(gamma)$^{-0.563}$ pascal-seconds, where gamma is a sheer rate of the fluid product. The aerosol system also includes a spray insert operatively coupled to the aerosol canister to receive the fluid product. The spray insert has a swirl chamber and a discharge outlet in fluid communication with the swirl chamber. The swirl chamber shears the fluid product flowing through the spray insert such that the fluid product discharged from the discharge outlet has a mean particle size between about 79 micrometers to about 121 micrometers.

According to another aspect, an aerosol system includes a container, an actuator operatively coupled to the container, and a spray insert in fluid communication with the container. When the actuator is in an actuated state for about three seconds and a fluid product stored in the container has a pressure of about 130 pounds per square inch (psi) to about 135 psi, the fluid product stored in the container discharges via the spray insert with an average particle size of between about 79 micrometers to about 96 micrometers. The spray insert enables between about 88% to about 97% of the fluid product discharged during the three seconds via the spray insert to deposit onto a substantially planar surface perpendicular to a central, longitudinal axis of the spray insert and spaced apart from the spray insert by a distance of about eight inches.

Additionally, when the actuator is in an actuated state for about three seconds and the fluid product stored in the container has a pressure of about 60 psi to about 70 psi, the fluid product stored in the container discharges via the spray insert with an average particle size of between about 90 micrometers to about 115 micrometers. The spray insert enables between about 92% to about 96% of the fluid product discharged during the three seconds via the spray insert to deposit onto a substantially planar surface perpendicular to the central, longitudinal axis of the spray insert and spaced apart from the spray insert by the distance of about eight inches.

Additionally, when the actuator is in an actuated state for about three seconds and the fluid product stored in the container has a pressure of about 50 psi to about 60 psi, fluid product stored in the container discharges via the spray insert with an average particle size of between about 105 micrometers to about 121 micrometers. The spray insert enables between about 91% and about 97% of the fluid product discharged via the spray insert during the about three seconds to deposit onto the substantially planar surface perpendicular to the central, longitudinal axis of the spray insert and spaced apart from the spray insert by the distance of about eight inches.

DETAILED DESCRIPTION

Figure 1:
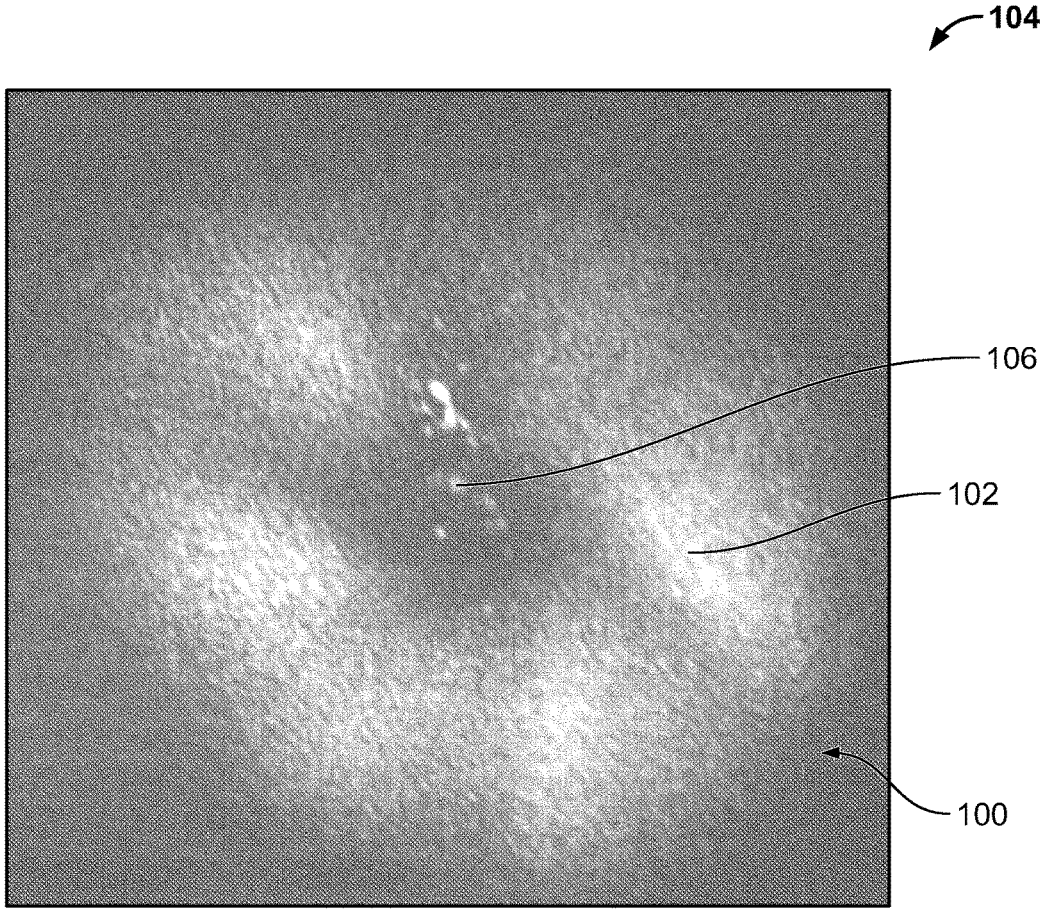
FIG. 1 illustrates a spray pattern of a fluid product generated via a traditional spray insert operatively coupled to an aerosol system.

With reference to FIG. 1, a common prior art spray pattern 100 is depicted. Such a spray pattern is generated by using traditional spray inserts with compressed gas aerosol systems to dispense a fluid product 102. During a spray procedure, the fluid product 102 is discharged and a pressure drop is realized within the compressed gas aerosol system, which is compounded over the life of the system as multiple spray procedures are performed. As a result, characteristics of the fluid product 102 including the flow rate, particle size, and viscosity change during the use of the aerosol system, which causes such traditional spray inserts to effect an uneven or inconsistent distribution of the fluid product 102 onto a surface, such as a substantially planar surface 104. For example, the spray pattern 100 illustrated in FIG. 1 includes deposits of the fluid product 102 in areas or spots on the surface 104 with discernibly different concentrations of the fluid product 102. Some of these deposits have sufficiently high concentrations of the fluid product 102 such that large drops or globs of the fluid product 102 are disposed on the surface 104. Further, a substantial proportion of the fluid product 102 deposited on the surface 104 is disposed at or near a center 106 of the spray pattern 100. As a result, a user may need to wipe the fluid product 102 deposited on the surface 104 using an undesirable number of strokes to apply the fluid product 102 to a desired portion of the surface 104 and/or the fluid product 102 may smear, be difficult to dry, and/or leave streaks on the surface 104.

Figure 2:
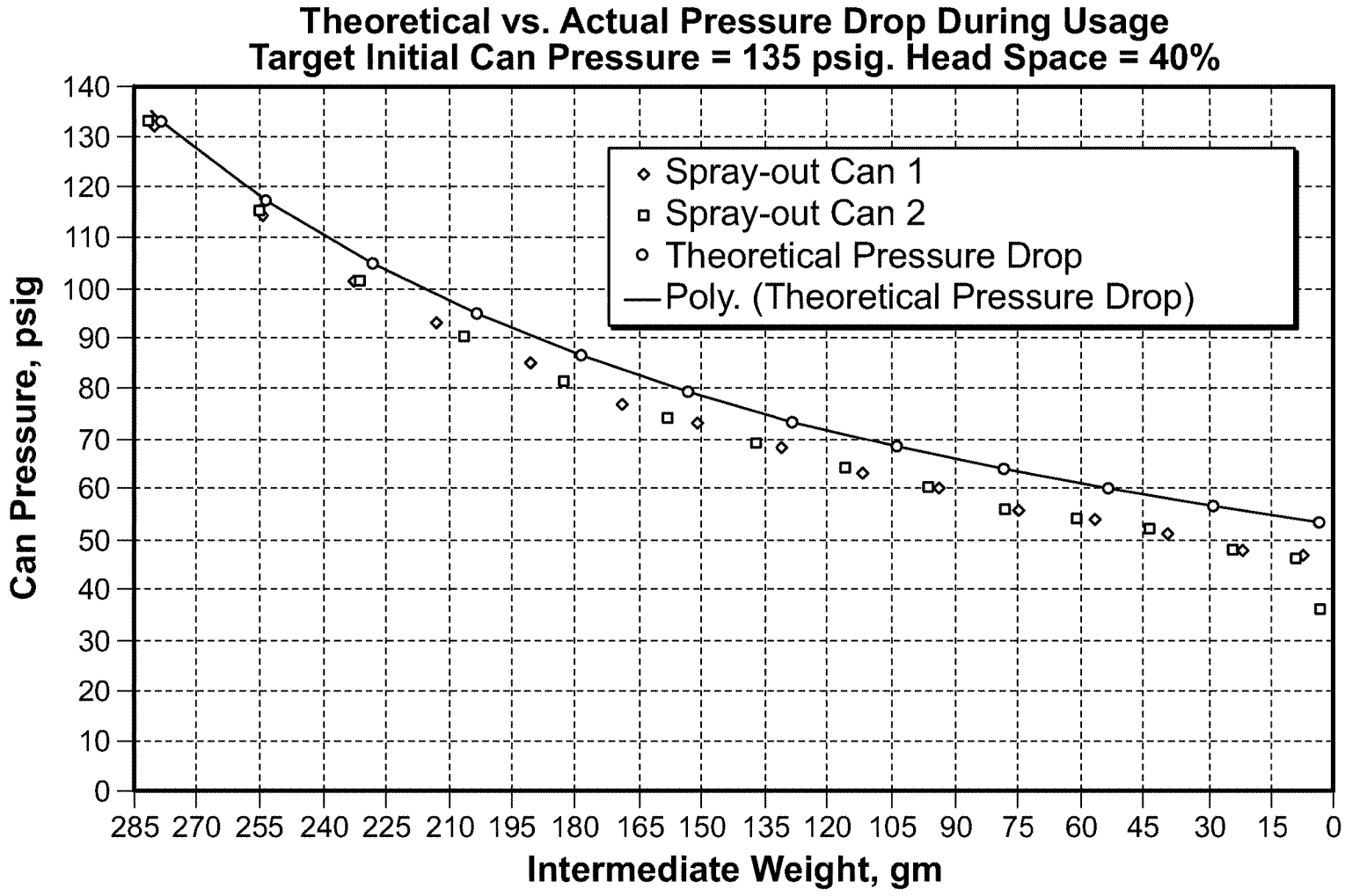
FIG. 2 is a graph illustrating a relationship between the fluid supply pressure of an aerosol canister and the intermediate weight of the fluid product in the aerosol canister during usage of the aerosol system of FIG. 1.
Figure 3:
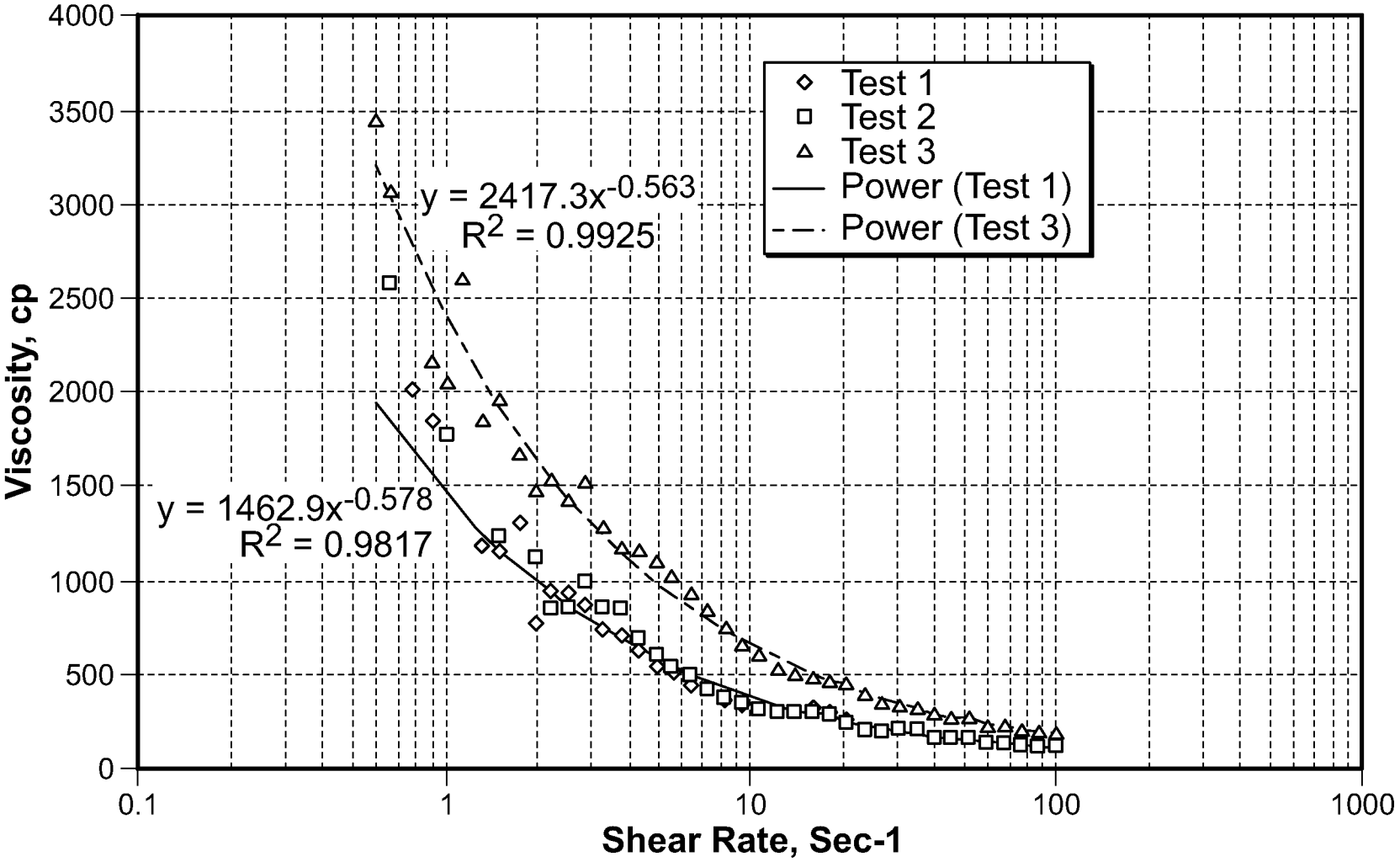
FIG. 3 is a graph illustrating a relationship between a viscosity of the fluid product of FIG. 1 and a shear rate of the fluid product.

FIGS. 2 and 3 are graphs illustrating characteristics of the fluid product 102 in an aerosol system employing compressed gas to dispense the fluid product 102. Specifically, FIG. 2 is a graph illustrating a relationship between fluid supply pressures of the aerosol system and intermediate weights of the fluid product 102 in an aerosol canister during use of the aerosol system from a first or full state to a second or depleted state. For example, as shown in FIG. 2, when the aerosol canister has head space of about 40% and an initial fluid supply pressure of about 135 pounds per square inch ("psi") in the first state, the canister has a fluid supply pressure of about 48 psi at the second state. In a different embodiment, when the aerosol canister is provided with a head space of about 30%, the fluid supply pressure decreases from about 135 psi to about 30 psi.

FIG. 3 is a graph illustrating a relationship between a viscosity of the fluid product 102 and a shear rate of the fluid product 102. The fluid product 102 of the present embodiment is a cleaning fluid having a specific gravity of 0.991 and a viscosity of $2.4173(\text{gamma})^{-0.563}$ pascal-seconds, where gamma is the shear rate of the fluid product 102. A surface tension coefficient of the fluid product 102 is 0.26 Newton/meter. The fluid product 102 is non-Newtonian. Thus, as illustrated in FIG. 3, the viscosity of the fluid product 102 decreases non-linearly as the shear rate of the fluid product 102 increases. When the pressure of the aerosol canister decreases during use, traditional spray inserts may begin to insufficiently shear the fluid product 102 as the fluid product 102 flows through the inserts. As a result, the particle sizes of the fluid product 102 discharged from traditional spray inserts increases and the spay pattern 100 narrows, causing uneven and inconsistent spray patterns such as the spray pattern 100 of FIG. 1. In other examples, the fluid product 102 may have different characteristics. For example, the fluid product 102 may have a viscosity between about 0 centipoise (cP) to about 2500 cP.

Figure 4:
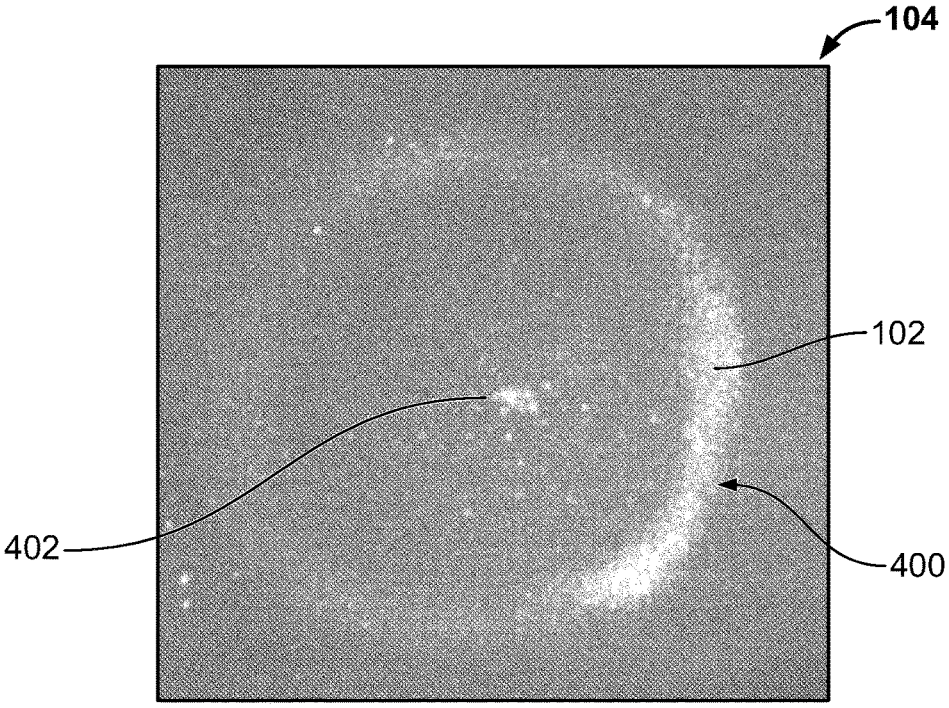
FIG. 4 illustrates a spray pattern in accordance with the teachings of the present disclosure.

FIG. 4 illustrates an example spray pattern 400 in accordance with the teachings of this disclosure. Spray inserts disclosed herein generate consistent and even spray patterns that alleviate or eliminate at least the above-noted shortcomings of the spray pattern 100 generated by traditional spray inserts. The spray inserts disclosed herein may also be used to discharge the fluid product 102 from an aerosol system employing compressed gas to dispense a fluid product 102, which has properties similar or identical to those described above with reference to FIGS. 2 and 3. However, unlike traditional spray inserts, the example spray inserts disclosed herein deposit consistent, even spray patterns of the fluid product 102 having a larger or wider area and/or span than the spray pattern 100 of FIG. 1. For example, the example spray pattern 400 is substantially annular, and when the fluid product 102 is discharged from about 8 inches away from the surface 104, the spray pattern 400 has an outer diameter or span of between about 5.5 inches and about 7.5 inches. In the illustrated example, between about 50% and about 97% of the fluid product 102 deposited onto the surface 104 is spaced apart from a center 402 of the spray pattern when the spray insert is disposed between about 1 inch and about eight inches from the surface 104. Further, the fluid product 102 deposited onto the surface 104 is substantially uniform in concentration about the spray pattern 400. In addition, droplet and/or particle sizes are substantially uniform about the entire flow path of the fluid product 102 when discharged via the example spray inserts disclosed herein, as compared to the substantially larger droplets and/or particles generated via traditional spray inserts. For example, the droplet and/or the particle sizes of the fluid product 102 discharged via the example spray inserts disclosed herein have a mean diameter of about 79 micrometers to about 121 micrometers. As a result, once the fluid product 102 is deposited on the surface 104 in the example spray pattern of FIG. 4, a user may quickly and easily wipe or spread the fluid product 102 over a desired portion of the surface 104 using fewer strokes than if the user employed a traditional spray insert to discharge the fluid product 102 onto the surface 104.

Figure 5:
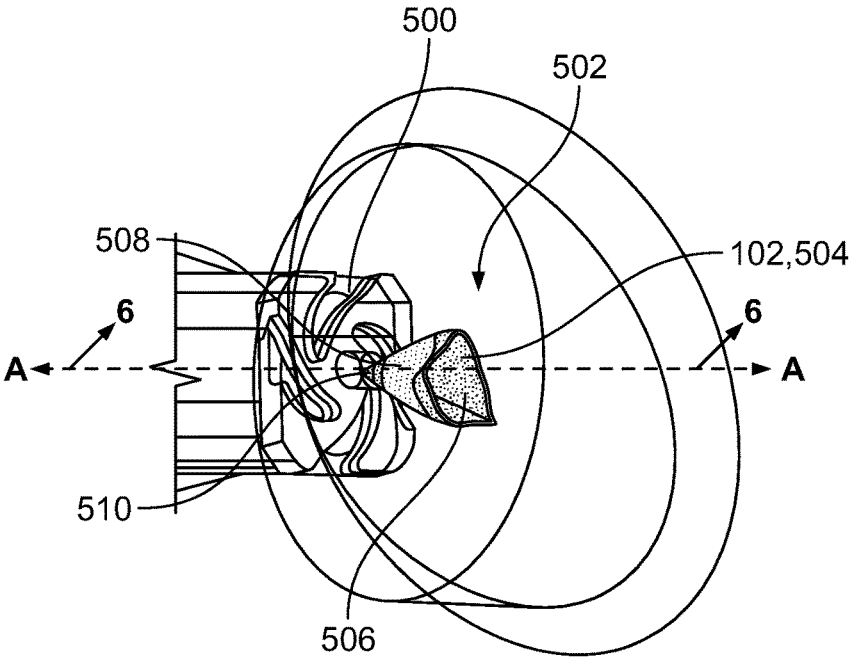
FIG. 5 is an isometric view of a spray insert disclosed herein discharging a sheet of a fluid product to generate an exemplary spray pattern such as shown in FIG. 4.

Turning to FIG. 5, an isometric view of an example spray insert 500 for discharging the fluid product 102 is shown. The spray pattern 400 of FIG. 4 may be effected through the generation of a fluid spray 502 of the fluid product 102. In the illustrated example, the fluid spray 502 is a substantially conical sheet 504 of the fluid product 102 comprising droplets or particles of the fluid product 102 having a mean diameter of about 79 micrometers to about 121 micrometers. In other examples, the droplet and/or the particle sizes of the fluid product 102 have other mean diameters, which may be larger or smaller. The example conical sheet 504 of FIG. 5 has an inner boundary 506 and an outer boundary 508. In the illustrated example, between about 50% and about 97% of the fluid product 102 discharged via the spray insert 500 is disposed within a volume defined between the inner boundary 506 and the outer boundary 508 for a distance of about eight inches from a discharge outlet or aperture 510 of the spray insert 500 along a central, longitudinal axis A-A of the spray insert 500.

Figure 6A:
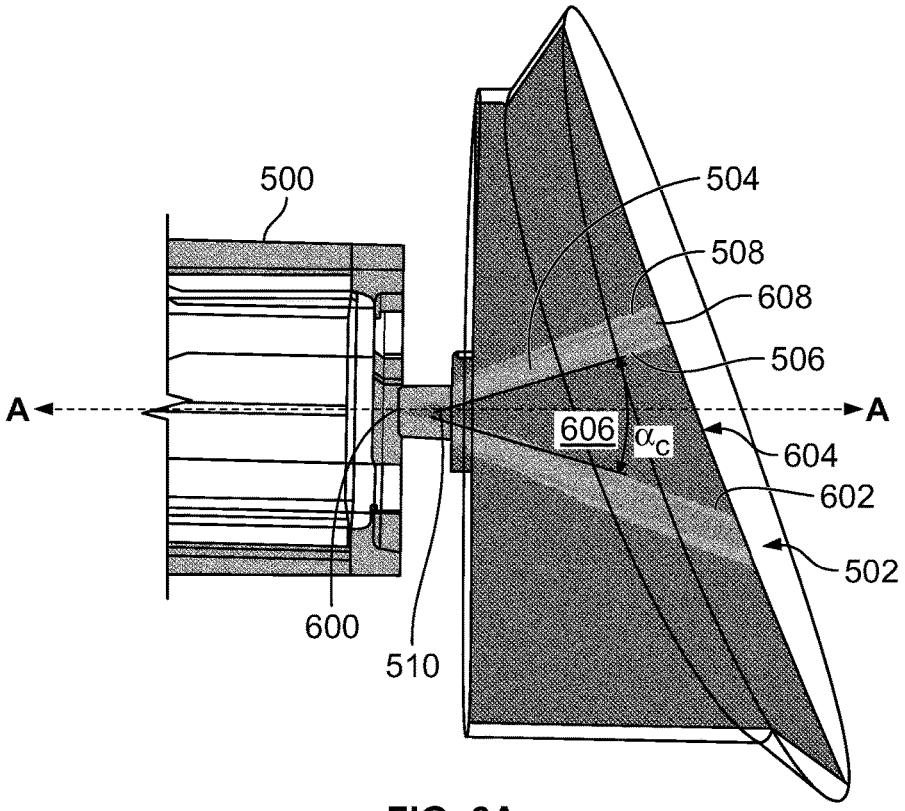
FIG. 6A is a cross-sectional view of the spray insert of FIG. 5 taken along the line 6-6 and a sheet of the fluid product emanating therefrom.

FIG. 6A is a cross-sectional view of the spray insert 500 and the sheet 504 of FIG. 5 along line 6-6 of FIG. 5. The example inner boundary 506 of the sheet 504 of FIG. 6A defines a vertex 600. In the illustrated example, the vertex 600 is disposed inside the spray insert 500. In other embodiments, the vertex 600 may be in a different location within the spray insert 500 or at the discharge outlet 510 thereof. The example sheet 504 spreads or flares away from the vertex 600 and away from the central, longitudinal axis A-A, which extends through a center 602 of the discharge outlet 510 of the spray insert 500. In the illustrated example, the sheet 504 further spreads or flares away from the central, longitudinal axis at the discharge outlet 510.

The sheet 504 of FIG. 5 has a cone angle $\alpha_c$, of approximately forty seven degrees. In other examples, the sheet 504 has other cone angles. The cone angle $\alpha_c$ is an angle taken through the central, longitudinal axis A-A and between two opposing portions of the sheet 504 outside of the spray insert 500. The inner boundary 506 of the example sheet 504 also includes a leading end 602 defining an opening 604. A space defined by the inner boundary 506 of the sheet 504 between the discharge aperture 510 and the opening 604 of the sheet 504 is substantially occupied by or filled with air. Thus, as referred herein, the space defined by the inner boundary 506 of the fluid spray 502 between the discharge aperture 510 and the opening 604 is referred to herein as an air core 606. In some examples, a portion of the air core 606 is substantially conical. In other examples, a portion of the air core 606 is substantially frustoconical. In yet other examples, the air core 606 takes on other shapes.

The sheet 504 of the fluid spray 502 of FIG. 6A has a substantially annular face 608 extending between the inner boundary 506 and the outer boundary 508. Therefore, because the example sheet 504 has the substantially annular face 608 and the air core 606 is disposed within the conical sheet 504, the fluid spray 502 deposits the fluid product 102 on the surface 104 in the example spray pattern 400 of FIG.

4. In some examples, between about 50% and about 97% of the fluid product 102 discharged from the spray insert 500 forms the annular spray pattern 400 of FIG. 4 on a surface if the spray insert 500 is used between about one inch to about eight inches from the surface 104.

Figure 6B:
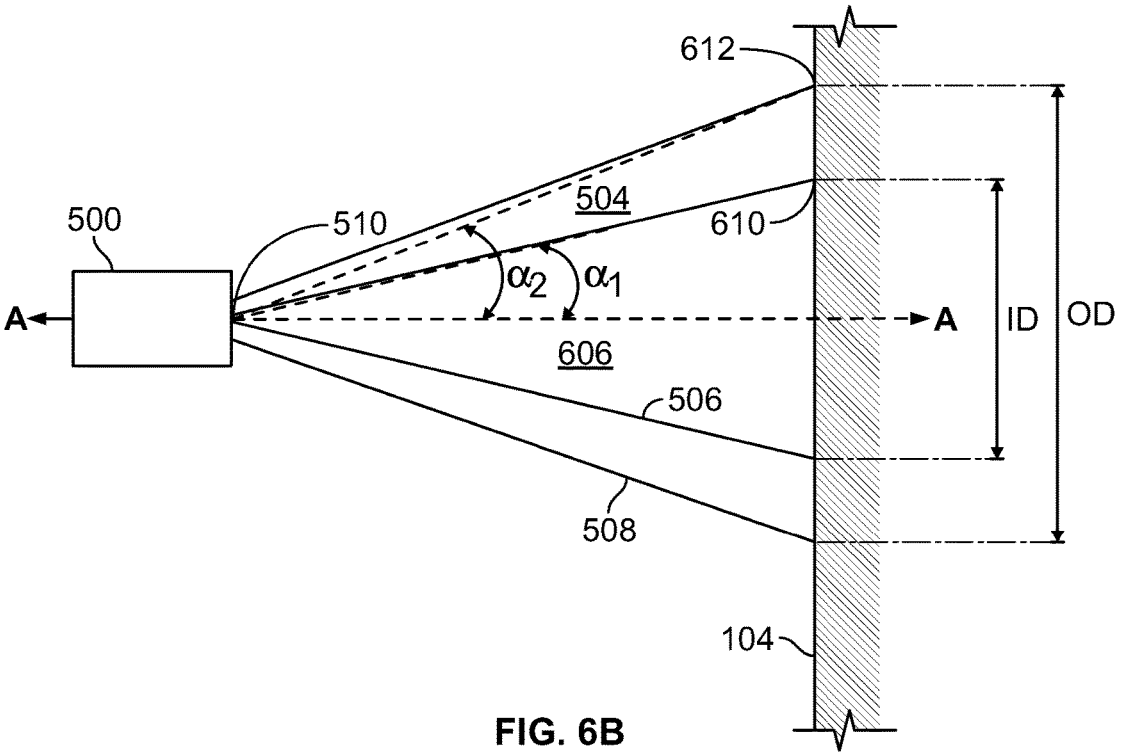
FIG. 6B is a schematic illustration of the spray insert of FIG. 5 discharging a sheet of a fluid product to generate an exemplary spray pattern such as shown in FIG. 4.

FIG. 6B is a schematic illustration of the spray insert 500 discharging the sheet 504 onto the surface 104. The spray insert 500 is oriented such that the central, longitudinal axis A-A is substantially perpendicular to the surface 104. Spray tests were conducted to determine characteristics of spray patterns formed via the spray insert 500. The spray tests were conducted by providing an aerosol system having the spray insert 500 operatively coupled to an aerosol canister holding the fluid product 102, shaking the canister for three seconds, and positioning the aerosol system relative to the surface 104 as shown in FIG. 6B at a distance of about eight inches from the surface. An actuator of the aerosol system was depressed for three seconds to discharge the fluid product 102 via the spray insert 500. The fluid product 102 discharged from the spray insert 500 formed a spray pattern on the surface 104 similar to the annular spray pattern 400 of FIG. 4. The spray pattern on the surface 104 of FIG. 6B was then measured by measuring an outer diameter OD of the spray pattern, an inner diameter ID of the spray pattern, a first angle $\alpha_1$ from the discharge outlet 510 at the central, longitudinal axis A-A to the an inner perimeter 610 of the spray pattern, and a second angle $\alpha_2$ from the discharge outlet 510 at the central, longitudinal axis A-A to an outer perimeter 612 of the spray pattern.

The above-noted tests were performed with the aerosol canister in a first state, a second state, and a third state. In the first state, the aerosol canister is filled with the fluid product 102. In the second state, the aerosol canister is about half filled with the fluid product 102. In the third state, the aerosol canister is about one quarter filled with the fluid product 102. The above noted tests were also conducted using the discharge outlet 510 with a diameter of 0.020 inches, 0.021 inches, and 0.022 inches. Tables 1-6 below detail the results of these tests.

TABLE 1

0.020" Discharge Outlet -- Test sample A

| | Weight (formula, cap, aerosol can) | OD Spray (in) | ID Spray (in) | Included Angle (OD) $\alpha_2$ | Included Angle (ID), $\alpha_1$ |
|---|---|---|---|---|---|
| Full Can | 360.9g | | | | |
| | | 6.5 | 3 | 44.2 | 21.2 |
| | | 6.5 | 3.5 | 44.2 | 24.7 |
| Average | | 6.7 | 3.3 | 45.2 | 23.5 |
| ½ full | 270.3 g | | | | |
| | | 6 | 3.5 | 41.1 | 24.7 |
| | | 6.5 | 4 | 44.2 | 28.1 |
| | | 6.5 | 4 | 44.2 | 28.1 |
| Average | | 6.3 | 3.8 | 43.2 | 26.9 |
| ¼ full | 181.2 g | | | | |
| | | 5.5 | 3.5 | 37.9 | 24.7 |
| | | 5.5 | 3.5 | 37.9 | 24.7 |
| | | 5.5 | 3.5 | 37.9 | 24.7 |
| Average | | 5.5 | 3.5 | 37.9 | 24.7 |

TABLE 2

0.020" Discharge Outlet -- Test sample B

| Full Can | Weight (formula, cap, aerosol can) | OD Spray (in) | ID Spray (in) | Included Angle (OD) $\alpha_2$ | Included Angle (ID), $\alpha_1$ |
|---|---|---|---|---|---|
| Full Can | 360.9g | | | | |
| | | 6 | 3 | 41.1 | 21.2 |
| | | 7 | 4 | 47.3 | 28.1 |
| | | 6.5 | 4.5 | 44.2 | 31.4 |
| Average | | 6.5 | 3.8 | 44.2 | 26.9 |
| ½ full | 271.2 g | | | | |
| | | 6.5 | 4 | 44.2 | 28.1 |
| | | 6.5 | 4 | 44.2 | 28.1 |
| | | 6.5 | 4 | 44.2 | 28.1 |
| Average | | 6.5 | 4.0 | 44.2 | 28.1 |
| ¼ full | 180.8 g | | | | |
| | | 5.5 | 4 | 37.9 | 28.1 |
| | | 6 | 4 | 41.1 | 28.1 |
| | | 5.8 | 4.0 | 39.5 | 28.1 |
| Average | | 5.8 | 4.0 | 39.5 | 28.1 |

TABLE 3

0.021" Discharge Outlet -- Test sample A

| | Weight (formula, cap, aerosol can) | OD Spray (in) | ID Spray (in) | Included Angle (OD) $\alpha_2$ | Included Angle (ID), $\alpha_1$ |
|---|---|---|---|---|---|
| Full Can | 363.7g | | | | |
| | | 7 | 4.5 | 47.3 | 31.4 |
| | | 7 | 4.5 | 47.3 | 31.4 |
| | | 7 | 4.5 | 47.3 | 31.4 |
| Average | | 7.0 | 4.5 | 47.3 | 31.4 |
| ½ full | 265 g | | | | |
| | | 6.5 | 4 | 44.2 | 28.1 |
| | | 7 | 4.5 | 47.3 | 31.4 |
| | | 7 | 4.5 | 47.3 | 31.4 |
| Average | | 6.8 | 4.3 | 46.2 | 30.3 |
| ¼ full | 180.4 g | | | | |
| | | 6 | 4 | 41.1 | 28.1 |
| | | 6 | 4 | 41.1 | 28.1 |
| | | 6 | 4 | 41.1 | 28.1 |
| Average | | 6.0 | 4.0 | 41.1 | 28.1 |

TABLE 4

0.021" Discharge Outlet -- Test sample B

| | Weight (formula, cap, aerosol can) | OD Spray (in) | ID Spray (in) | Included Angle (OD) $\alpha_2$ | Included Angle (ID), $\alpha_1$ |
|---|---|---|---|---|---|
| Full Can | 363.4g | | | | |
| | | 7 | 4 | 47.3 | 28.1 |
| | | 7 | 4 | 47.3 | 28.1 |
| | | 7 | 4 | 47.3 | 28.1 |
| Average | | 7.0 | 4.0 | 47.3 | 28.1 |
| ½ full | 271.7 g | | | | |
| | | 6 | 4.5 | 41.1 | 31.4 |
| | | 6.5 | 4.5 | 44.2 | 31.4 |
| | | 6.5 | 4.5 | 44.2 | 31.4 |
| Average | | 6.3 | 4.5 | 43.2 | 31.4 |
| ¼ full | 181 g | | | | |
| | | 6 | 4 | 41.1 | 28.1 |
| | | 5.5 | 4 | 37.9 | 28.1 |
| | | 6.0 | 4.0 | 41.1 | 28.1 |
| Average | | 5.8 | 4.0 | 40.1 | 28.1 |

TABLE 5

| 0.022" Discharge Outlet -- Test sample A | | | | | |
|---|---|---|---|---|---|
| | Weight (formula, cap, aerosol can) | OD Spray (in) | ID Spray (in) | Included Angle (OD) $\alpha_2$ | Included Angle (ID), $\alpha_1$ |
| Full Can | 362.5g | | | | |
| | | 7.5 | 5 | 50.2 | 34.7 |
| | | 7.5 | 5 | 50.2 | 34.7 |
| | | 7.5 | 5 | 50.2 | 34.7 |
| Average | | 7.5 | 5.0 | 50.2 | 34.7 |
| ½ full | 270 g | | | | |
| | | 7 | 4.5 | 47.3 | 31.4 |
| | | 7 | 5 | 47.3 | 34.7 |
| | | 7 | 5 | 47.3 | 34.7 |
| Average | | 7.0 | 4.8 | 47.3 | 33.6 |
| ¼ full | 180 g | | | | |
| | | 7 | 5 | 47.3 | 34.7 |
| | | 7 | 5 | 47.3 | 34.7 |
| | | 7 | 5 | 47.3 | 34.7 |
| Average | | 7.0 | 5.0 | 47.3 | 34.7 |

TABLE 6

| 0.022" Discharge Outlet -- Test sample B | | | | | |
|---|---|---|---|---|---|
| | Weight (formula, cap, aerosol can) | OD Spray (in) | ID Spray (in) | Included Angle (OD) $\alpha_2$ | Included Angle (ID), $\alpha_1$ |
| Full Can | 363.7g | | | | |
| | | 7 | 4.5 | 47.3 | 31.4 |
| | | 7.5 | 5 | 50.2 | 34.7 |
| | | 7.5 | 5 | 50.2 | 34.7 |
| Average | | 7.3 | 4.8 | 49.2 | 33.6 |
| ½ full | 270 g | | | | |
| | | 7 | 5.5 | 47.3 | 37.9 |
| | | 7 | 5 | 47.3 | 34.7 |
| | | 7 | 5 | 47.3 | 34.7 |
| Average | | 7.0 | 5.2 | 47.3 | 35.8 |
| ¼ full | 180 g | | | | |
| | | 6.5 | 4.5 | 44.2 | 31.4 |
| | | 6.5 | 4.5 | 44.2 | 31.4 |
| | | 6.5 | 4.5 | 44.2 | 31.4 |
| Average | | 6.5 | 4.5 | 44.2 | 31.4 |

Additional spray tests were also conducted to determine amounts of the fluid product 102 discharged onto the surface 104. The spray tests were conducted by providing an aerosol system having the spray insert 500 operatively coupled to an aerosol canister holding the fluid product 102. The spray aerosol canister was weighed via a scale. A foil sheet was cut to size based on an estimated spray pattern size on the surface. The foil sheet was then weighed, and a first weight of the foil sheet was tared out of the scale (e.g., the scale was zeroed). The foil sheet was then disposed on the surface 104. The aerosol canister was then shaken for three seconds and positioned relative to the surface 104 as shown in FIG. 6B. An actuator of the aerosol system was depressed for three seconds to discharge the fluid product 102 via the spray insert 500. The fluid product 102 discharged from the spray insert 500 formed a spray pattern on the foil sheet similar to the annular spray pattern 400 of FIG. 4. The foil sheet was then removed from the surface 104 and weighed. A second weight of the foil sheet with the fluid product 102 deposited thereon was compared with the first weight of the foil sheet without the fluid product 102 deposited thereon to determine an amount of the fluid product 102 deposited on the foil sheet.

The above-noted tests were performed with the aerosol canister in the first state, the second state, and the third state. As described above, in the first state, the aerosol canister is filled with the fluid product 102. In the second state, the aerosol canister is about half filled with the fluid product 102. In the third state, the aerosol canister is about one quarter filled with the fluid product 102. The above noted tests were also conducted using the discharge outlet 510 with a diameter of 0.020 inches, 0.021 inches, and 0.022 inches. Further, the tests were performed when the spray insert 500 was positioned at distances of about one inch, about six inches, about eight inches, and about nine inches from the surface 104. The tests at the distance of about eight inches from the surface 104 were performed using two substantially similar or identical aerosol systems, which are indicated in the following tables as sample A and sample B, respectively. Tables 7-18 detail the results of these tests.

TABLE 7

| Full Can (130-135 psi) - Spray Insert 1" from Surface | | | | | | | |
|---|---|---|---|---|---|---|---|
| Sample | Discharge Outlet Diameter | Initial Can Wt (g) | Can Wt after 3 Second Spray (g) | Product on foil (g) | Can Delta Wt (g) | Percentage of Spray Product on foil | Avg |
| A | .020" | 369.16 | 367.72 | 1.4 | 1.44 | 97 | 98 |
| | .020" | 367.72 | 365.6 | 2.08 | 2.12 | 98 | |
| | .020" | 365.6 | 363.53 | 2.01 | 2.07 | 97 | |
| A | .021" | 365.77 | 363.45 | 2.25 | 2.32 | 97 | 97 |
| | .021" | 360.46 | 358.43 | 1.95 | 2.03 | 96 | |
| | .021" | 358.43 | 356.08 | 2.3 | 2.35 | 98 | |
| A | .022" | 367.77 | 365.16 | 2.56 | 2.61 | 98 | 98 |
| | .022" | 362.57 | 359.69 | 2.81 | 2.88 | 98 | |
| | .022" | 359.69 | 356.81 | 2.81 | 2.88 | 98 | |

TABLE 8

| Full Can (130-135 psi) - Spray Insert 6" from Surface | | | | | | | |
|---|---|---|---|---|---|---|---|
| Sample | Discharge Outlet Diameter | Initial Can Wt (g) | Can Wt after 3 Second Spray (g) | Product on foil (g) | Can Delta Wt (g) | Percentage of Spray Product on foil | Avg |
| A | .020" | 370.8 | 367.49 | 3.1 | 3.31 | 94 | 93 |
| | .020" | 367.49 | 364.9 | 2.39 | 2.59 | 92 | |
| | .020" | 364.9 | 362.5 | 2.26 | 2.4 | 94 | |
| A | .021" | 372.53 | 369.81 | 2.54 | 2.72 | 93 | 92 |
| | .021" | 369.81 | 367.49 | 2.09 | 2.32 | 90 | |
| | .021" | 367.49 | 364.93 | 2.37 | 2.56 | 93 | |
| A | .022" | 366.55 | 363.68 | 2.65 | 2.87 | 92 | 93 |
| | .022" | 363.68 | 360.32 | 3.15 | 3.36 | 94 | |
| | .022" | 360.32 | 357.76 | 2.39 | 2.56 | 93 | |

TABLE 9

| Full Can (130-135 psi) - Spray Insert 8" from Surface | | | | | | | |
|---|---|---|---|---|---|---|---|
| Sample | Discharge Outlet Diameter | Initial Can Wt (g) | Can Wt after 3 Second Spray (g) | Product on foil (g) | Can Delta Wt (g) | Percentage of Spray Product on foil | Avg |
| A | .020" | 352.3 | 349.7 | 2.51 | 2.6 | 97 | 92 |
| | .020" | 349.7 | 347.04 | 2.38 | 2.66 | 89 | |
| | .020" | 347.04 | 343.9 | 2.87 | 3.14 | 91 | |
| B | .020" | 343.9 | 340.5 | 3.18 | 3.4 | 94 | |
| | .020" | 340.5 | 337.54 | 2.68 | 2.96 | 91 | |
| | .020" | 337.54 | 333.98 | 3.22 | 3.56 | 90 | |
| A | .021" | 353.66 | 350.37 | 3.02 | 3.29 | 92 | 90 |

TABLE 9-continued

Full Can (130-135 psi) - Spray Insert 8" from Surface

| Sample | Discharge Outlet Diameter | Initial Can Wt (g) | Can Wt after 3 Second Spray (g) | Product on foil (g) | Can Delta Wt (g) | Percentage of Spray Product on foil | Avg |
|---|---|---|---|---|---|---|---|
| | .021" | 350.37 | 346.95 | 3.13 | 3.42 | 92 | |
| | .021" | 346.95 | 343.25 | 3.32 | 3.7 | 90 | |
| B | .021" | 343.25 | 339.18 | 3.7 | 4.07 | 91 | |
| | .021" | 339.18 | 335.61 | 3.16 | 3.57 | 89 | |
| | .021" | 335.61 | 331.99 | 3.26 | 3.62 | 90 | |
| A | .022" | 353.3 | 348.94 | 3.93 | 4.36 | 90 | 90 |
| | .022" | 348.94 | 344.71 | 3.84 | 4.23 | 91 | |
| | .022" | 344.71 | 340.43 | 3.78 | 4.28 | 88 | |
| B | .022" | 340.43 | 336.48 | 3.61 | 3.95 | 91 | |
| | .022" | 336.48 | 332.11 | 3.87 | 4.37 | 89 | |
| | .022" | 332.11 | 328.01 | 3.71 | 4.1 | 90 | |

TABLE 10

Full Can (130-135 psi) - Spray Insert 9" from Surface

| Sample | Discharge Outlet Diameter | Initial Can Wt (g) | Can Wt after 3 Second Spray (g) | Product on foil (g) | Can Delta Wt (g) | Percentage of Spray Product on foil | Avg |
|---|---|---|---|---|---|---|---|
| A | .020" | 369.08 | 366.19 | 2.58 | 2.89 | 89 | 89 |
| | .020" | 366.19 | 363.13 | 2.69 | 3.06 | 88 | |
| | .020" | 363.13 | 359.95 | 2.85 | 3.18 | 90 | |
| A | .021" | 361.24 | 357.75 | 2.97 | 3.49 | 85 | 87 |
| | .021" | 357.75 | 354.28 | 3.06 | 3.47 | 88 | |
| | .021" | 354.28 | 351.13 | 2.75 | 3.15 | 87 | |
| A | .022" | 367.29 | 363.84 | 3.1 | 3.45 | 90 | 87 |
| | .022" | 363.84 | 360.78 | 2.63 | 3.06 | 86 | |
| | .022" | 360.78 | 357.62 | 2.7 | 3.16 | 85 | |

TABLE 11

Half full Can (60-70 psi) - Spray Insert 1" from Surface

| Sample | Discharge Outlet Diameter | Initial Can Wt (g) | Can Wt after 3 Second Spray (g) | Product on foil (g) | Can Delta Wt (g) | Percentage of Spray Product on foil | Avg |
|---|---|---|---|---|---|---|---|
| A | .020" | 237.31 | 235.52 | 1.77 | 1.79 | 99 | 98 |
| | .020" | 235.52 | 233.11 | 2.36 | 2.41 | 98 | |
| | .020" | 233.11 | 230.99 | 2.11 | 2.12 | 100 | |
| A | .021" | 237.2 | 235.49 | 1.69 | 1.71 | 99 | 98 |
| | .021" | 235.49 | 233.74 | 1.73 | 1.75 | 99 | |
| | .021" | 233.74 | 232.22 | 1.48 | 1.52 | 97 | |
| A | .022" | 236.6 | 235.28 | 1.28 | 1.32 | 97 | 98 |
| | .022" | 235.28 | 233.54 | 1.73 | 1.74 | 99 | |
| | .022" | 233.54 | 231.49 | 1.99 | 2.05 | 97 | |

TABLE 12

Half full Can (60-70 psi) - Spray Insert 6" from Surface

| Sample | Discharge Outlet Diameter | Initial Can Wt (g) | Can Wt after 3 Second Spray (g) | Product on foil (g) | Can Delta Wt (g) | Percentage of Spray Product on foil | Avg |
|---|---|---|---|---|---|---|---|
| A | .020" | 230.98 | 228.92 | 1.97 | 2.06 | 96 | 96 |
| | .020" | 228.92 | 226.68 | 2.16 | 2.24 | 96 | |
| | .020" | 226.68 | 224.37 | 2.2 | 2.31 | 95 | |

TABLE 12-continued

Half full Can (60-70 psi) - Spray Insert 6" from Surface

| Sample | Discharge Outlet Diameter | Initial Can Wt (g) | Can Wt after 3 Second Spray (g) | Product on foil (g) | Can Delta Wt (g) | Percentage of Spray Product on foil | Avg |
|---|---|---|---|---|---|---|---|
| A | .021" | 229.04 | 226.96 | 2 | 2.08 | 96 | 96 |
| | .021" | 226.66 | 224.46 | 2.12 | 2.2 | 96 | |
| | .021" | 224.46 | 222.37 | 2.01 | 2.09 | 96 | |
| A | .022" | 231.48 | 228.97 | 2.43 | 2.51 | 97 | 97 |
| | .022" | 228.97 | 226.91 | 1.98 | 2.06 | 96 | |
| | .022" | 226.91 | 224.76 | 2.08 | 2.15 | 97 | |

TABLE 13

Half Full Can (60-70 psi) - Spray Insert 8" from Surface

| Sample | Discharge Outlet Diameter | Initial Can Wt (g) | Can Wt after 3 Second Spray (g) | Product on foil (g) | Can Delta Wt (g) | Percentage of Spray Product on foil | Avg |
|---|---|---|---|---|---|---|---|
| A | .020" | 238.91 | 235.97 | 2.73 | 2.94 | 93 | 94 |
| | .020" | 235.97 | 232.76 | 3.02 | 3.21 | 94 | |
| | .020" | 232.76 | 229.76 | 2.81 | 3 | 94 | |
| B | .020" | 229.76 | 226.52 | 3.05 | 3.24 | 94 | |
| | .020" | 226.52 | 223.08 | 3.26 | 3.44 | 95 | |
| | .020" | 223.08 | 219.86 | 2.97 | 3.22 | 92 | |
| A | .021" | 239.37 | 236.33 | 2.84 | 3.04 | 93 | 94 |
| | .021" | 236.33 | 233.1 | 3.01 | 3.23 | 93 | |
| | .021" | 233.1 | 229.81 | 3.1 | 3.29 | 94 | |
| B | .021" | 229.81 | 226.78 | 2.85 | 3.03 | 94 | |
| | .021" | 226.78 | 223.52 | 3.12 | 3.26 | 96 | |
| | .021" | 223.52 | 219.71 | 3.56 | 3.81 | 93 | |
| A | .022" | 236.58 | 232.95 | 3.44 | 3.63 | 95 | 94 |
| | .022" | 232.95 | 229.51 | 3.28 | 3.44 | 95 | |
| | .022" | 229.51 | 226 | 3.31 | 3.51 | 94 | |
| B | .022" | 226 | 222.47 | 3.28 | 3.53 | 93 | |
| | .022" | 222.47 | 218.82 | 3.45 | 3.65 | 95 | |
| | .022" | 218.82 | 215.37 | 3.26 | 3.45 | 94 | |

TABLE 14

Half full Can (60-70 psi) - Spray Insert 9" from Surface

| Sample | Discharge Outlet Diameter | Initial Can Wt (g) | Can Wt after 3 Second Spray (g) | Product on foil (g) | Can Delta Wt (g) | Percentage of Spray Product on foil | Avg |
|---|---|---|---|---|---|---|---|
| A | .020" | 230.11 | 227.26 | 2.64 | 2.85 | 93 | 93 |
| | .020" | 227.26 | 224.59 | 2.49 | 2.67 | 93 | |
| | .020" | 224.59 | 222.34 | 2.1 | 2.25 | 93 | |
| A | .021" | 227.86 | 224.7 | 2.84 | 3.16 | 90 | 92 |
| | .021" | 224.37 | 221.62 | 2.53 | 2.75 | 92 | |
| | .021" | 221.62 | 218.91 | 2.55 | 2.71 | 94 | |
| A | .022" | 235.84 | 233.21 | 2.43 | 2.63 | 92 | 92 |
| | .022" | 233.21 | 230.52 | 2.5 | 2.69 | 93 | |
| | .022" | 230.52 | 227.5 | 2.77 | 3.02 | 92 | |

TABLE 15

| Quarter full Can (50-60 psi) - Spray Insert 1" from Surface | | | | | | | |
|---|---|---|---|---|---|---|---|
| Sample | Discharge Outlet Diameter | Initial Can Wt (g) | Can Wt after 3 Second Spray (g) | Product on foil (g) | Can Delta Wt (g) | Percentage of Spray Product on foil | Avg |
| A | .020" | 171.29 | 169.6 | 1.67 | 1.69 | 99 | 98 |
| | .020" | 169.6 | 168.11 | 1.46 | 1.49 | 98 | |
| | .020" | 168.11 | 166.57 | 1.52 | 1.54 | 99 | |
| A | .021" | 173.7 | 172.16 | 1.49 | 1.54 | 97 | 98 |
| | .021" | 172.16 | 170.6 | 1.56 | 1.56 | 100 | |
| | .021" | 170.6 | 168.96 | 1.61 | 1.64 | 98 | |
| A | .022" | 172.5 | 170.78 | 1.67 | 1.72 | 97 | 98 |
| | .022" | 170.78 | 169.28 | 1.49 | 1.5 | 99 | |
| | .022" | 169.28 | 167.15 | 2.09 | 2.13 | 98 | |

TABLE 16

| Quarter full Can (50-60 psi) - Spray Insert 6" from Surface | | | | | | | |
|---|---|---|---|---|---|---|---|
| Sample | Discharge Outlet Diameter | Initial Can Wt (g) | Can Wt after 3 Second Spray (g) | Product on foil (g) | Can Delta Wt (g) | Percentage of Spray Product on foil | Avg |
| A | .020" | 181.2 | 179.24 | 1.91 | 1.96 | 97 | 96 |
| | .020" | 179.24 | 177.45 | 1.69 | 1.79 | 94 | |
| | .020" | 177.45 | 175.96 | 1.45 | 1.49 | 97 | |
| A | .021" | 180.71 | 179.17 | 1.45 | 1.54 | 94 | 96 |
| | .021" | 179.17 | 177.64 | 1.48 | 1.53 | 97 | |
| | .021" | 177.1 | 175.42 | 1.63 | 1.68 | 97 | |
| A | .022" | 181.99 | 180.15 | 1.79 | 1.84 | 97 | 98 |
| | .022" | 180.15 | 178.42 | 1.69 | 1.73 | 98 | |
| | .022" | 178.42 | 176.76 | 1.62 | 1.66 | 98 | |

TABLE 17

| Quarter Full Can (50-60 psi) - Spray Insert 8" from Surface | | | | | | | |
|---|---|---|---|---|---|---|---|
| Sample | Discharge Outlet Diameter | Initial Can Wt (g) | Can Wt after 3 Second Spray (g) | Product on foil (g) | Can Delta Wt (g) | Percentage of Spray Product on foil | Avg |
| A | .020" | 176.9 | 174.07 | 2.73 | 2.83 | 96 | 95 |
| | .020" | 174.07 | 171.17 | 2.8 | 2.9 | 97 | |
| | .020" | 171.17 | 167.8 | 3.19 | 3.37 | 95 | |
| B | .020" | 167.8 | 165.19 | 2.51 | 2.61 | 96 | |
| | .020" | 165.19 | 162.29 | 2.72 | 2.9 | 94 | |
| | .020" | 162.29 | 159.57 | 2.58 | 2.72 | 95 | |
| A | .021" | 179.44 | 176.83 | 2.49 | 2.61 | 95 | 96 |
| | .021" | 176.83 | 173.8 | 2.89 | 3.03 | 95 | |
| | .021" | 173.8 | 170.82 | 2.85 | 2.98 | 96 | |
| B | .021" | 170.82 | 168.1 | 2.63 | 2.72 | 97 | |
| | .021" | 168.1 | 164.56 | 3.34 | 3.54 | 94 | |
| | .021" | 161.15 | 158.15 | 2.87 | 3 | 96 | |
| A | .022" | 179.68 | 176.95 | 2.62 | 2.73 | 96 | 94 |
| | .022" | 176.95 | 174.12 | 2.67 | 2.83 | 94 | |
| | .022" | 174.12 | 170.95 | 2.95 | 3.17 | 93 | |
| B | .022" | 170.95 | 167.81 | 2.87 | 3.14 | 91 | |
| | .022" | 167.81 | 164.21 | 3.4 | 3.6 | 94 | |
| | .022" | 164.21 | 161.25 | 2.83 | 2.96 | 96 | |

TABLE 18

| Quarter full Can (50-60 psi) - Spray Insert 9" from Surface | | | | | | | |
|---|---|---|---|---|---|---|---|
| Sample | Discharge Outlet Diameter | Initial Can Wt (g) | Can Wt after 3 Second Spray (g) | Product on foil (g) | Can Delta Wt (g) | Percentage of Spray Product on foil | Avg |
| A | .020" | 178.54 | 176.81 | 1.61 | 1.73 | 93 | 94 |
| | .020" | 176.81 | 175.09 | 1.64 | 1.72 | 95 | |
| | .020" | 175.09 | 173.29 | 1.68 | 1.8 | 93 | |
| A | .021" | 180.89 | 178.97 | 1.79 | 1.92 | 93 | 93 |
| | .021" | 178.97 | 177.39 | 1.48 | 1.58 | 94 | |
| | .021" | 177.39 | 175.4 | 1.85 | 1.99 | 93 | |
| A | .022" | 175.93 | 173.82 | 1.98 | 2.11 | 94 | 94 |
| | .022" | 173.82 | 171.54 | 2.14 | 2.28 | 94 | |
| | .022" | 171.54 | 169.76 | 1.69 | 1.78 | 95 | |

As shown in Tables 7-18, between about 90% to about 97% of the fluid product 102 discharged via the spray insert 500 deposits on the surface 104 when the spray insert 500 is between about 1 inch and about 8 inches away from the surface 104.

Spray tests were also conducted to determine average particle sizes of the fluid product 102 using the spray insert 500. Each of the tests was performed using two substantially similar aerosol systems, indicated as sample A and sample B, respectively. Each of the spray tests was conducted by providing an aerosol system having the spray insert 500 operatively coupled to an aerosol canister holding the fluid product 102, shaking the canister for three seconds, and actuating an actuator of the aerosol system for about three seconds to discharge the fluid product 102 via the spray insert 500. The average particle size was measured and/or calculated via a particle size analyzer manufactured and/or sold by Malvern Instruments, Ltd. These tests were performed with an aerosol canister in the first state, the second state, and the third state. The tests were also conducted using the discharge outlet 510 with a diameter of 0.020 inches, 0.021 inches, and 0.022 inches. The following tables detail the results of these tests.

TABLE 19

| Full Can (130-135 psi) | | | | |
|---|---|---|---|---|
| Sample | Discharge Outlet Diameter | Average particle size (μm) | Starting Can WT (g) | Average (μm) |
| A | .020" | 79.44 | 352.03 | 87 |
| | .020" | 90.16 | | |
| | .020" | 88.25 | | |
| B | .020" | 88.08 | 333.27 | |
| | .020" | 87.73 | | |
| | .020" | 86.76 | | |
| A | .021" | 90.8 | 349.07 | 91 |
| | .021" | 93.87 | | |
| | .021" | 92.25 | | |
| B | .021" | 94.08 | 309.67 | |
| | .021" | 79.14 | | |
| | .021" | 96.08 | | |
| A | .022" | 84.77 | 333.73 | 88 |
| | .022" | 84.54 | | |
| | .022" | 87.4 | | |
| B | .022" | 86.9 | 350.6 | |
| | .022" | 89.11 | | |
| | .022" | 92.56 | | |

As shown in Table 19, the average particle size of the fluid product 102 discharged from a substantially full aerosol canister via the spray insert 500 is about 79 micrometers to about 96 micrometers.

TABLE 20

| Half Full Can (60-70 psi) | | | | |
|---|---|---|---|---|
| Sample | Discharge Outlet Diameter | Average particle size (μm) | Starting Can WT (g) | Average (μm) |
| A | .020" | 91.82 | 234.95 | 99 |
| | .020" | 95.35 | | |
| | .020" | 98.56 | | |
| B | .020" | 103.2 | 220.3 | |
| | .020" | 104.9 | | |
| | .020" | 102.9 | | |
| A | .021" | 101.7 | 238.12 | 108 |
| | .021" | 107.2 | | |
| | .021" | 99.74 | | |
| B | .021" | 109.2 | 224.89 | |
| | .021" | 113.9 | | |
| | .021" | 115.2 | | |
| A | .022" | 99.48 | 235.35 | 95 |
| | .022" | 90.14 | | |
| | .022" | 91.45 | | |
| B | .022" | 95.52 | 220.5 | |
| | .022" | 93.37 | | |
| | .022" | 100.2 | | |

As shown in Table 20, the average particle size of the fluid product 102 discharged from a substantially half full aerosol canister via the spray insert 500 is about 90 micrometers to about 115 micrometers.

TABLE 21

| Quarter Full Can (50-60 psi) | | | | |
|---|---|---|---|---|
| Sample | Discharge Outlet Diameter | Average particle size (μm) | Starting Can WT (g) | Average (μm) |
| A | .020" | 109.7 | 180.3 | 115 |
| | .020" | 118 | | |
| | .020" | 120.9 | | |
| B | .020" | 112.2 | 168.64 | |
| | .020" | 115.4 | | |
| | .020" | 116.3 | | |
| A | .021" | 110 | 179.79 | 112 |
| | .021" | 112.7 | | |
| | .021" | 111.7 | | |
| B | .021" | 111.8 | 164.95 | |
| | .021" | 114.7 | | |
| | .021" | 109.1 | | |
| A | .022" | 105.5 | 168.66 | 110 |
| | .022" | 117.7 | | |
| | .022" | 100.6 | | |
| B | .022" | 110.5 | 154.67 | |
| | .022" | 110.4 | | |
| | .022" | 113.1 | | |

As shown in Table 21, the average particle size of the fluid product 102 discharged from a substantially quarter full aerosol canister via the spray insert 500 is about 105 micrometers to about 121 micrometers.

Figure 7:
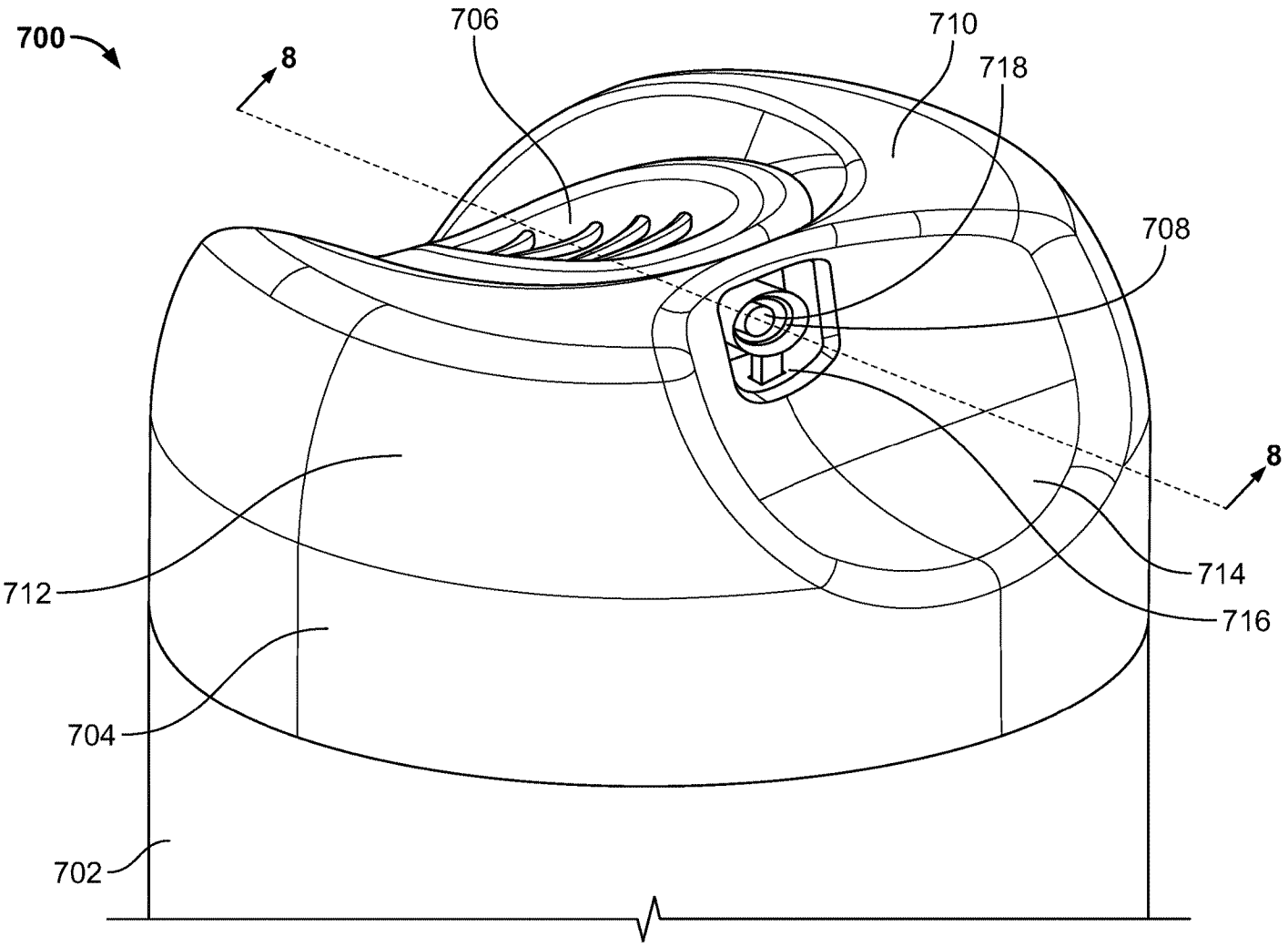
FIG. 7 is a perspective view of a front and left side of one possible overcap assembly for use with a spray insert.

FIG. 7 illustrates an example overcap assembly 700 coupled to an aerosol canister 702. Although the following examples are described with reference to the overcap assembly 700 of FIG. 7, other overcap assemblies may be used without departing from the scope of this disclosure. For example, aspects of aerosol dispenser assemblies described in U.S. patent application Ser. No. 13/428,936, which was filed on Mar. 23, 2012, may be used to implement the examples disclosed herein. The overcap assembly 700 is provided to discharge the fluid product 102 from the aerosol canister 702 and generate the example spray pattern 400 of FIG. 4 on the surface 104. In the illustrated example, the aerosol canister 702 contains the fluid product 102, and the fluid product has characteristics substantially the same or similar to the characteristics described above with reference to FIGS. 2 and 3. In some examples, the fluid product dispensed may include a fragrance, insecticide, or other product disposed within a carrier liquid, a deodorizing liquid, or the like. For example, the fluid product may comprise OUST™, Pledge™, Windex™, or GLADE®, for household, commercial, and institutional use, all of which are sold by S.C. Johnson and Son, Inc., of Racine, Wis. The fluid product may also comprise other actives, such as sanitizers, air and/or fabric fresheners, cleaners, odor eliminators, mold or mildew inhibitors, insect repellents, and the like, or that have aromatherapeutic properties. The fluid product alternatively comprises any fluid known to those skilled in the art that can be dispensed from a container, such as those suitable for dispersal in the form of particles or droplets suspended within a gas. The overcap assembly 700 is therefore adapted to dispense any number of different fluid or product formulations.

In the illustrated example, the overcap assembly 700 includes a housing 704, an actuator 706, and a spray insert 708. The example actuator 706 of FIG. 7 is a button movably coupled to an upper portion (e.g., a top or a ceiling) 710 of the housing 704. In other examples, the actuator 706 may be implemented in other ways. For example, the actuator 706 may be a trigger disposed on a side 712 of the housing 704. In the illustrated example, the upper portion 710 and the side 712 of the housing 704 define a recessed portion 714 and an aperture or opening 716 in the recessed portion 714. The spray insert 708 is in fluid communication with the aperture 716 to effect spraying into the ambient environment. In the present embodiment, a discharge outlet 718 of the spray insert 708 is aligned with (e.g., concentric to) the aperture 716 such that the fluid product 102 discharged via the spray insert 708 is directed through the aperture 716 and out of the overcap assembly 700 into the ambient environment.

Figure 8:
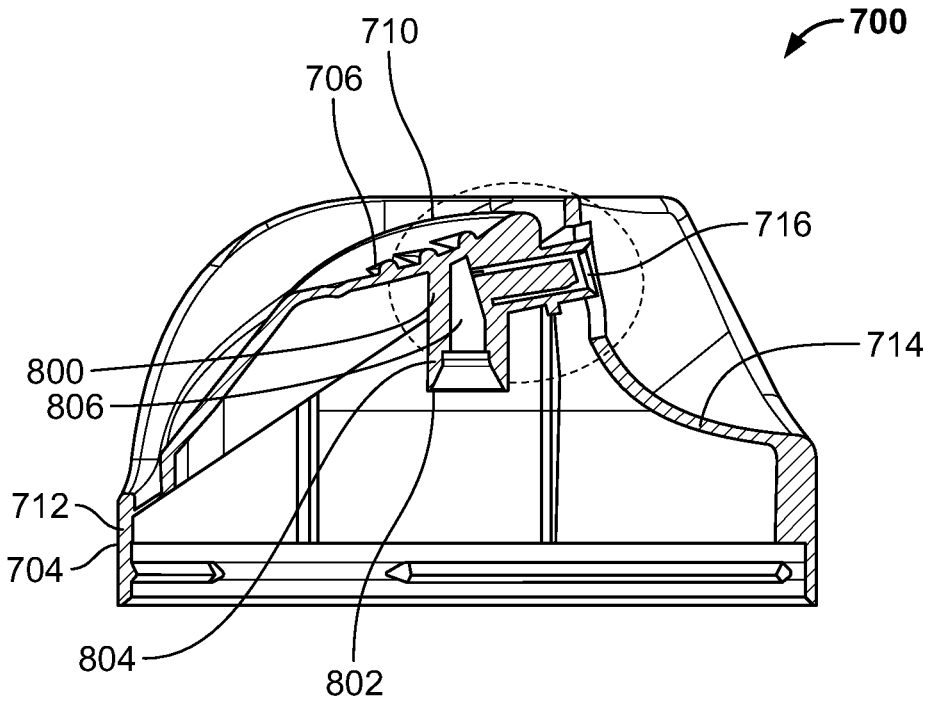
FIG. 8 is a cross-sectional view of the overcap assembly of FIG. 7 taken along line 8-8.

FIG. 8 is a cross-sectional view of the overcap assembly 700 without the example spray insert 708. In the illustrated example, the actuator 706 is operatively coupled to a manifold 800. For example, the example actuator 706 of FIGS. 7 and 8 is integral with the housing 704 and the manifold 800. In other examples, the actuator 706 is operatively coupled to the manifold 800 in one or more additional and/or alternative ways. In the illustrated example, the manifold 800 includes an inlet end 802 to be fluidly coupled to a valve stem (e.g., a tilt valve stem or a vertical valve stem) of the aerosol canister 702. In the illustrated example, the inlet end 802 includes a flared portion 804 to receive and/or couple to the valve stem of the aerosol canister 702. When the inlet end 802 is fluidly coupled to the valve stem, movement of the actuator 706 from an unactuated position to an actuated position moves the manifold 800 to actuate the valve stem. When the valve stem is actuated or activated, the valve stem releases the fluid product 102 from the aerosol canister 702 into a first fluid passageway 806 defined by the manifold 800. In the illustrated example, the first fluid passageway 806 is substantially parallel to a longitudinal axis of the valve stem when the overcap assembly 700 is coupled to the aerosol canister 702.

Figure 9:
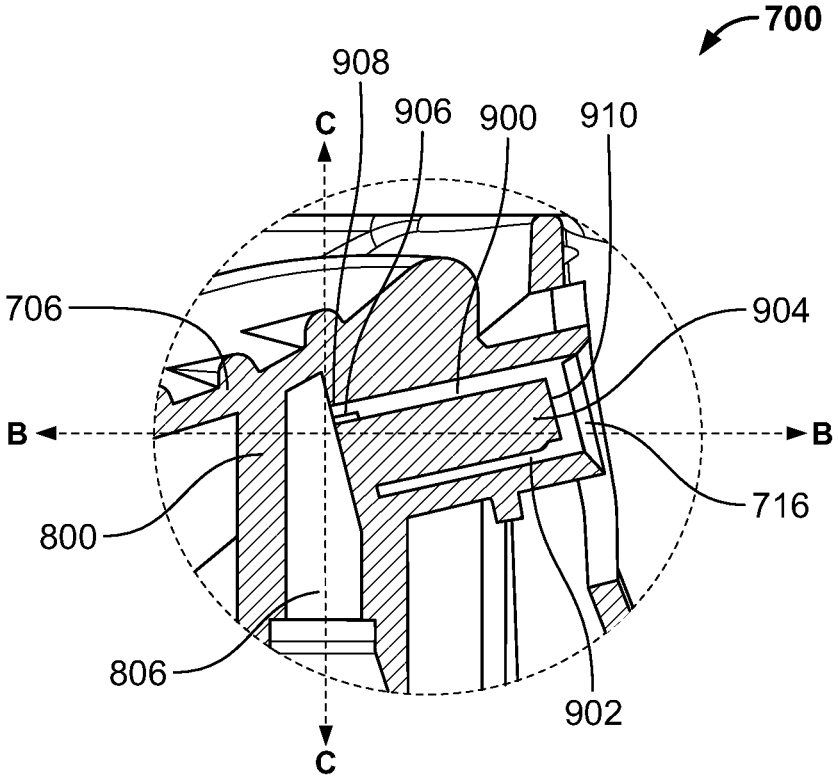
FIG. 9 is a partial, enlarged view of the overcap assembly of FIG. 8.

FIG. 9 is an enlarged cross-sectional view of the overcap assembly 700 of FIGS. 7 and 8. As may be seen, the manifold 800 defines a second fluid passageway 900 in fluid communication with the first fluid passageway 806. The second fluid passageway 900 of FIG. 9 is oriented about positive thirty degrees from an axis B-B perpendicular to a longitudinal axis C-C of the first fluid passageway 806. Thus, the example second fluid passageway 900 directs the fluid product 102 from the first fluid passageway 806 toward the side 712 of the housing 704 of the overcap assembly 700. In other examples, the second fluid passageway 900 is oriented in other ways relative to the first fluid passageway 806 (e.g., perpendicularly or at a negative angle from the axis B-B). The example manifold 800 includes an annular channel 902 defining a post 904 extending substantially parallel to the second fluid passageway 900. In the illustrated example, the second fluid passageway 900 is in fluid communication with the annular channel 902. A stop 906 such as, for example, a protrusion, is disposed on the post 904 at or near a junction 908 of the first fluid passageway 806 and the second fluid passageway 900. As described in greater detail below, the spray insert 708 is to be at least partially disposed in the annular channel 902 and supported via the stop 906 and/or a distal end 910 of the post 904 to fluidly couple the spray insert 708 to the second fluid passageway 900 of the manifold 800. In some examples, the spray insert 708 includes the post 904. In other examples, the spray insert 708 and the manifold 800 are integral. In some examples, the spray insert 708 is configured in other ways. For example, a trigger may include aspects of the spray insert 708 (e.g., a swirl chamber) in accordance with the teachings of this disclosure.

Figure 10:
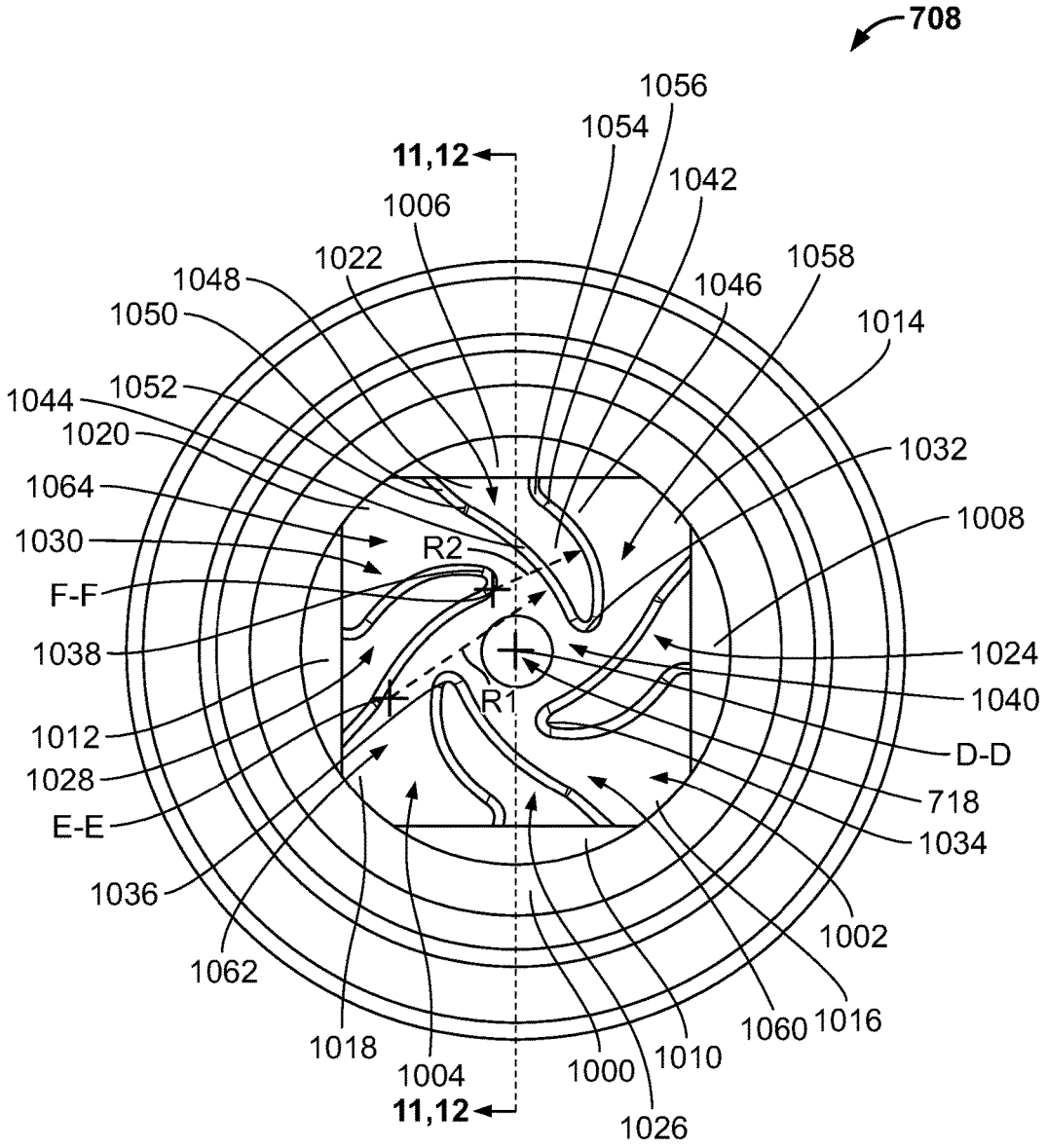
FIG. 10 is a rear elevational view of one embodiment of a spray insert disclosed herein, which may be used to effect the spray pattern of FIG. 4.
Figure 11:
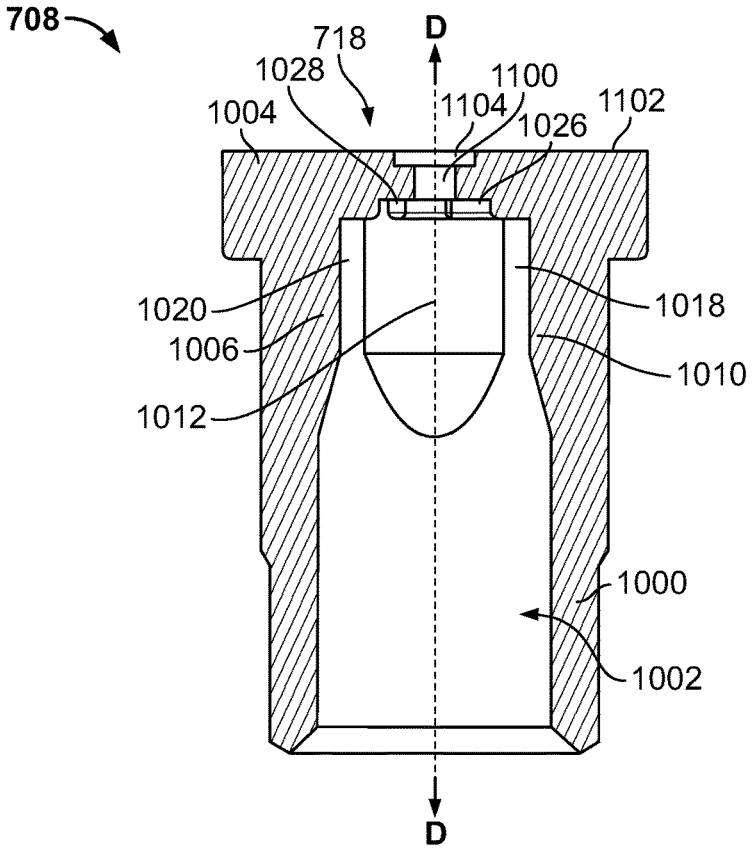
FIG. 11 is a cross-sectional, elevational view of the example spray insert of FIG. 10 taken along line 11-11.
Figure 12:
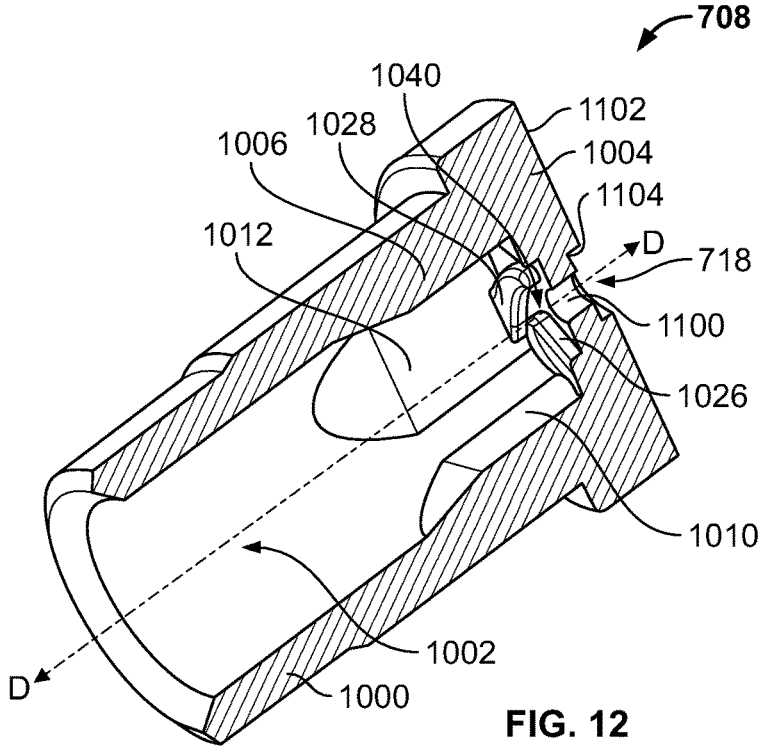
FIG. 12 is a cross-sectional, perspective view of the example spray insert of FIG. 11.

FIGS. 10-12 illustrate an exemplary spray insert 708 in accordance with the teachings of this disclosure. With reference to FIG. 10, a rear, elevational view of the example spray insert 708 is depicted, whereas FIG. 11 depicts a cross-sectional, elevational view of the spray insert 708 along line 11-11 of FIG. 10 and FIG. 12 shows a cross-sectional, isometric view of the spray insert 708 along line 12-12 of FIG. 10. The example spray insert 708 of FIGS. 10-12 is capable of generating the sheet 504 of the fluid product 102 of FIG. 5 to create a spray pattern similar or identical to the spray pattern 400 of FIG. 4. However, the example spray insert 708 of FIGS. 10-12 is merely an illustrative example. Therefore, the sheet 504 and the example spray pattern 400 may be generated using spray inserts implemented in other ways without departing from the scope of this disclosure.

Turning to FIGS. 10 and 11, the example spray insert 708 includes a sidewall 1000 defining a cavity 1002 to receive the post 904 of the manifold 800. Positioning the spray insert 708 in the annular channel 902 places the second fluid passageway 900 of the manifold 800 in fluid communication with the spray insert 708. The spray insert 708 of FIG. 10 also includes an endwall 1004 integrally formed with the sidewall 1000. The discharge outlet 718 is provided within the endwall 1004, and as shown in FIG. 11, the discharge outlet 718 is disposed along a central, longitudinal axis D-D of the spray insert 708 and is in fluid communication with the cavity 1002.

The example spray insert 708 includes a first vane or baffle 1006, a second vane or baffle 1008, a third vane or baffle 1010, and a fourth vane or baffle 1012 disposed on the sidewall 1000 within the cavity 1002. In the illustrated example, the vanes 1006-1012 are symmetrically disposed in the cavity 1002 relative to the central, longitudinal axis D-D (FIG. 11) of the spray insert 708. For example, the first vane 1006 is disposed opposite the third vane 1010 along a first plane, and the second vane 1008 is disposed opposite the fourth vane 1012 along a second plane perpendicular to the first plane. In the illustrated example, the vanes 1006-1012 are spaced apart to define a first longitudinal channel 1014, a second longitudinal channel 1016, a third longitudinal channel 1018, and a fourth longitudinal channel 1020, which extend substantially parallel to the central, longitudinal axis D-D (FIG. 11) of the spray insert 708. When the fluid product 102 enters the cavity 1002 of the spray insert 708 from the manifold 800, the fluid product 102 flows into an annulus defined by the post 904 and the sidewall 1000 of the spray insert 708. The fluid product 102 flowing through the annulus is divided by the vanes 1006-1012 into flow paths defined by the longitudinal channels 1014-1020 and the post 904. As a result, the vanes 1006-1012 direct the fluid product 102 to flow through each of the longitudinal channels 1014, 1016, 1018, 1020 toward the endwall 1004 of the spray insert 708.

The spray insert 708 also includes a first boss or tooth 1022, a second boss or tooth 1024, a third boss or tooth 1026, and a fourth boss or tooth 1028 disposed on an interior surface 1030 of the endwall 1004. In the illustrated example, the bosses 1022-1028 are spaced apart from each other. The first boss 1022 extends from the first vane 1006 toward the second vane 1008 and the third vane 1010. The second boss 1024 extends from the second vane 1008 toward the third vane 1010 and the fourth vane 1012. The third boss 1026 extends from the third vane 1010 toward the fourth vane 1012 and the first vane 1006. The fourth boss 1028 extends from the fourth vane 1012 toward the first vane 1006 and the second vane 1008. Thus, the first boss 1022 mirrors the third boss 1026, and the second boss 1024 mirrors the fourth boss 1028.

In the illustrated example, a first end or tip 1032 of the first boss 1022, a second end or tip 1034 of the second boss 1024, a third end or tip 1036 of the third boss 1026, and a fourth end or tip 1038 of the fourth boss 1028 are spaced apart from the discharge outlet 718 of the spray insert 708. As a result, portions of the bosses 1022-1028 and a portion of the interior surface 1030 of the endwall 1004 surrounding the discharge outlet 718 define a swirl chamber 1040 in which the fluid product 102 flowing through the spray insert 708 swirls, rotates and/or circulates prior to flowing out of the spray insert 708 via the discharge outlet 718. The swirl chamber 1040 has a height corresponding to a distance between the interior surface 1030 of the endwall 1004 and the distal end 910 of the post 904 when the spray insert 708 is coupled to the manifold 800.

In the illustrated example, the bosses 1022-1028 are substantially similar or identical. Thus, the following description of the first boss 1022 is applicable to the second boss 1024, the third boss 1026, and the fourth boss 1028. Therefore, for the sake of brevity, the second boss 1024, the third boss 1026, and the fourth boss 1028 are not separately described herein.

The example first boss 1022 has an airfoil-shaped portion 1042. For example, a first side portion 1044 of the first boss 1022 has a first radius of curvature R1, and a second side portion 1046 of the first boss 1022 has a second radius of curvature R2 less than the first radius of curvature R1. In some examples, the first radius of curvature R1 is about 0.066 inches, and the second radius of curvature R2 is about 0.036 inches. The first radius of curvature R1 is substantially constant over a first arc length of the first side portion 1044. The second radius of curvature R2 is substantially constant over a second arc length of the second side portion 1046. Thus, the first boss 1022 includes a first area and a second area between the sidewall 1000 and the first tip 1032 having constant radii of curvature. In other examples, the first radius of curvature R1 and/or the second radius of curvature R2 changes over the first arc length and the second arc length, respectively.

In the illustrated example, the first arc length of the first side portion 1044 is longer than the second arc length of the second side portion 1046. The first side portion 1044 and the second side portion 1046 are curved about a first axis or center of curvature E-E and a second axis or center of curvature F-F, respectively. In the illustrated example, the first axis of curvature E-E and the second axis of curvature F-F parallel to the central longitudinal axis D-D (see also FIG. 11) of the spray insert 708. The second axis of curvature F-F is offset from the first axis of curvature E-E in two perpendicular directions (e.g., up and to the right in the perspective of FIG. 10). The first axis of curvature E-E and the second axis of curvature F-F extend through the endwall 1004 adjacent the fourth boss 1028. As a result, the first side portion 1044 and the second side portion 1046 curve substantially in a direction of rotation of the fluid product 102 in the swirl chamber 1040 to facilitate rotation of the fluid product 102 prior to the fluid product 102 flowing into the swirl chamber 1040.

The first boss 1022 also includes a base portion 1048 extending from the first vane 1006 to the airfoil shaped portion 1042. For example, the base portion 1048 has a third side portion 1050 extending from the first vane 1006 to a first point of inflection 1052 formed by the third side portion 1050 and the first side portion 1044. The base portion 1048 also includes a fourth side portion 1054 extending from the first vane 1006 to a second point of inflection 1056 formed by the fourth side portion 1054 and the second side portion 1046. Thus, the first side portion 1044 extends from the third side portion 1050 of the base portion 1048 at the first point of inflection 1052 to the first tip 1032, and the second side portion 1046 extends from the fourth side portion 1054 of the base portion 1048 at the second point of inflection 1056 to the first tip 1032. In the illustrated example, the third side portion 1050 and the fourth side portion 1054 extend (e.g., curve) from the first vane 1006 toward the second boss 1024.

The first tip 1032 of the first boss 1022 is curved or rounded. In other examples, the first tip 1032 of the first boss 1022 is a linear edge. The above-noted shapes of the first boss 1022 cause the fluid product 102 to rotate and/or swirl in the swirl chamber 1040 of FIGS. 10 and 12 at a higher velocity and, thus, shear at a higher rate than the fluid product 102 shears in traditional spray inserts. In other examples, the first boss 1022, the second boss 1024, the third boss 1026, and/or the fourth boss 1028 are other shapes and/or are oriented in one or more additional and/or alternative ways.

In the illustrated example, the fluid product 102 flows through the longitudinal channels 1014-1020 between the vanes 1006-1012 and into a first lateral or oblique channel 1058 defined by the first boss 1022 and the second boss 1024, a second lateral or oblique channel 1060 defined by the second boss 1024 and the third boss 1026, a third lateral or oblique channel 1062 defined by the third boss 1026 and the fourth boss 1028, and a fourth lateral or oblique channel 1064 defined by the fourth boss 1028 and the first boss 1022, respectively. The oblique channels 1058-1064 decrease in width or span from the sidewall 1000 toward the swirl chamber 1040. As a result, the oblique channels 1058-1064 increase a velocity of the fluid product 102 as the fluid product 102 flows through the oblique channels 1058-1064 and into the swirl chamber 1040. The curvature and orientation of the bosses 1022-28 and, thus, the shapes of the oblique channels 1058-1064 direct the fluid to rotate about the longitudinal axis D-D when the fluid product is in the oblique channels 1058-1064. As a result, the curvature and orientation of the bosses 1022-28 and, thus, the shapes of the oblique channels 1058-1064 direct the fluid product to rotate about the longitudinal axis D-D upstream of the swirl chamber 1040.

Referring to FIG. 11, the spray insert 708 includes a bore 1100 defining the discharge outlet 718. The bore 1100 extends through the endwall 1004. In the illustrated example, the bore 1100 has a uniform diameter. In other examples, the discharge outlet 718 may be implemented in other ways. For example, a portion of the discharge outlet 718 may define a fluid passageway having a decreasing or increasing diameter or taper. An exterior end 1102 of the endwall 1004 includes a counterbore 1104 surrounding the bore 1100. In some examples, the endwall 1004 does not include the counterbore 1104.

Figure 13:
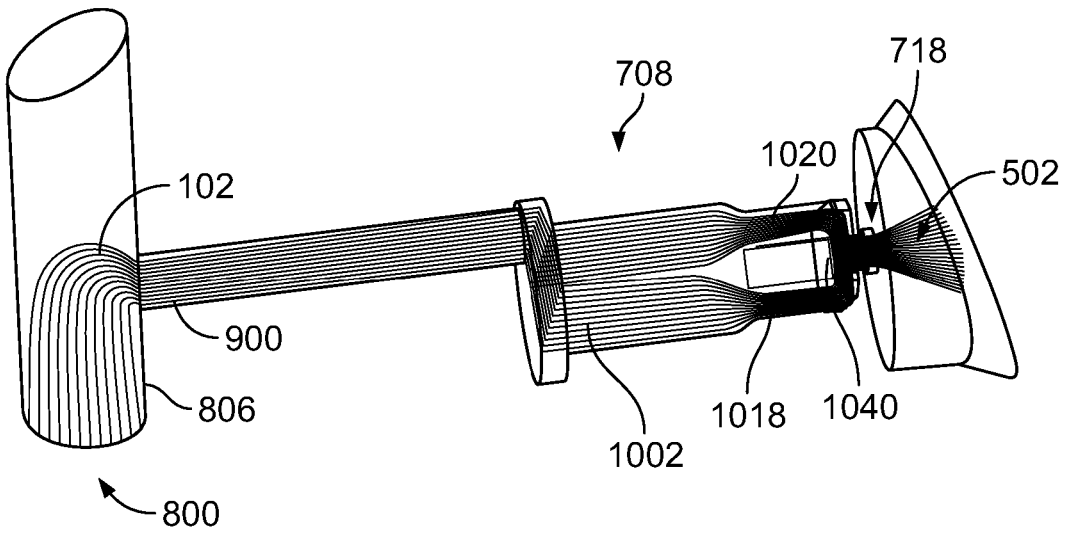
FIG. 13 is a schematic illustration of exemplary flowpaths of a fluid product through an overcap assembly such as the one shown in FIG. 7.
Figure 14:
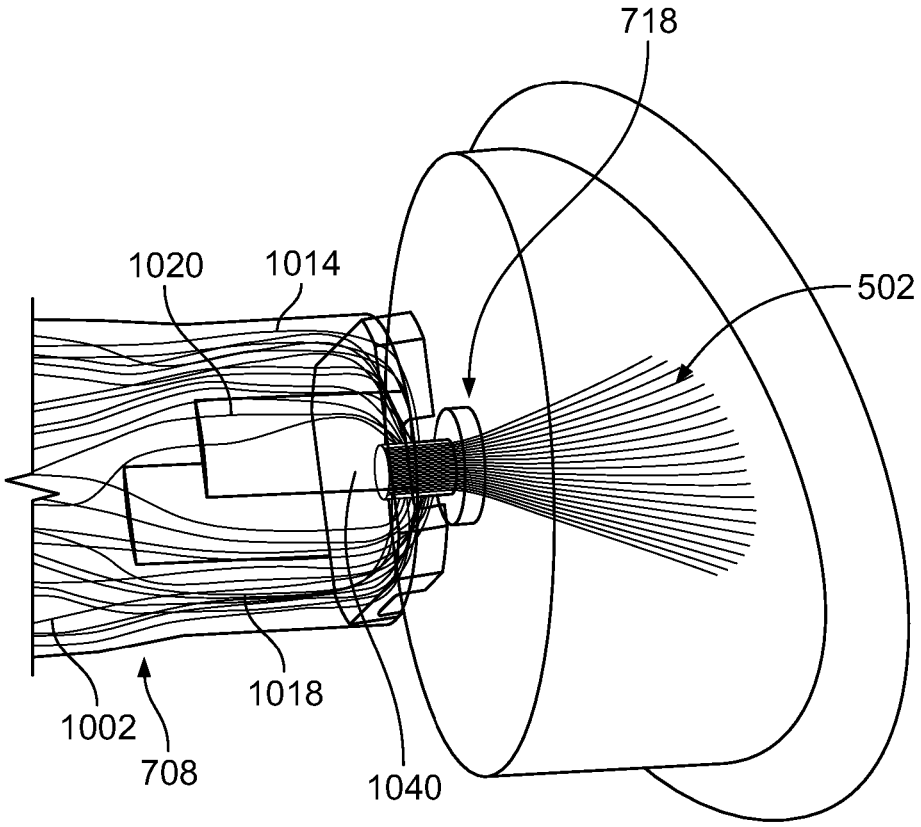
FIG. 14 is an enlarged schematic illustration of the flowpaths of the fluid product depicted in FIG. 13.

FIGS. 13 and 14 are schematic illustrations of exemplary flowpaths of a fluid product through an overcap assembly such as the one shown in FIG. 7. Features of the overcap assembly of FIGS. 13 and 14 are referenced using like reference numbers for like components. Thus, the fluid product 102 illustrated in FIG. 13 flows through the first fluid passageway 806 and the second fluid passageway 900 of the manifold 800 and into the cavity 1002 of the spray insert 708. The fluid product 102 then flows through the longitudinal channels 1014-1020, through the oblique channels 1058-1064, and into the swirl chamber 1040.

Figure 15:
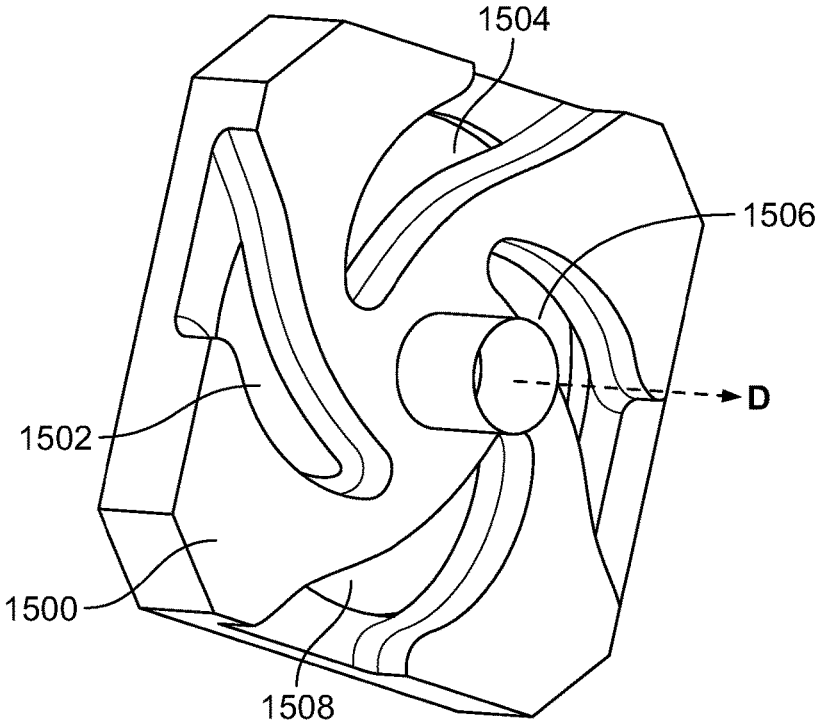
FIG. 15 is a three-dimensional representation of flow paths of a fluid product into and through a swirl chamber of the spray insert of FIG. 10.

FIG. 15 is a three-dimensional representation of the flow paths of the fluid product 102 through the oblique channels 1058-1064, in the swirl chamber 1040, and through the discharge outlet 718 as described in connection with FIGS. 13 and 14. Shaded portions 1500 of the three-dimensional representation of the flow paths represent the fluid product 102, and voids 1502, 1504, 1506, 1508 represent the bosses 1022-1028, respectively. The fluid product 102 rotates or swirls about the central, longitudinal axis D-D in the swirl chamber 1040 and then flows through the discharge outlet 718. The fluid product 102 continues to rotate or swirl as the fluid product 102 moves through the discharge outlet 718 and into the ambient environment. Rotation of the fluid product 102 in the swirl chamber 1040 shears the fluid product 102. As a result, the viscosity of the fluid product 102 decreases as well as the particle and/or droplet size of the fluid product 102. In the present system, the fluid product 102 discharges from the discharge outlet 718 at a flow rate of between about 2.4 grams per second and about 2.7 grams per second and with a droplet and/or particle size having a mean diameter of between about 79 micrometers to about 121 micrometers. In some embodiments, the fluid product 102 has a peak tangential velocity in the spray insert 708 (e.g., in the bore 1100) of between about 11 meters per second and 13 meters per second. In other embodiments, the fluid product 102 has other peak tangential velocities. In addition, rotation of the fluid product 102 via the swirl chamber 1040 urges the fluid product 102 away from the central, longitudinal axis D-D of the spray insert 708. As a result, when the fluid product 102 flows through the bore 1100, the fluid product 102 spreads or flares away from the central, longitudinal axis D-D and forms a conical sheet having an air core such as illustrated by the sheet 504 of FIG. 5 and the air core 606 of FIG. 6A. In the illustrated example, the fluid product 102 initially spreads or flares away from the central, longitudinal axis D-D when the fluid product 102 is flowing through the bore 1100. When the example spray insert 708 is disposed a suitable distance from a surface such as, for example, the surface 104 of FIG. 4, a fluid spray of the fluid product 102 generates a spray pattern similar to the spray pattern 400 of FIG. 4 on the surface.

Figure 16:
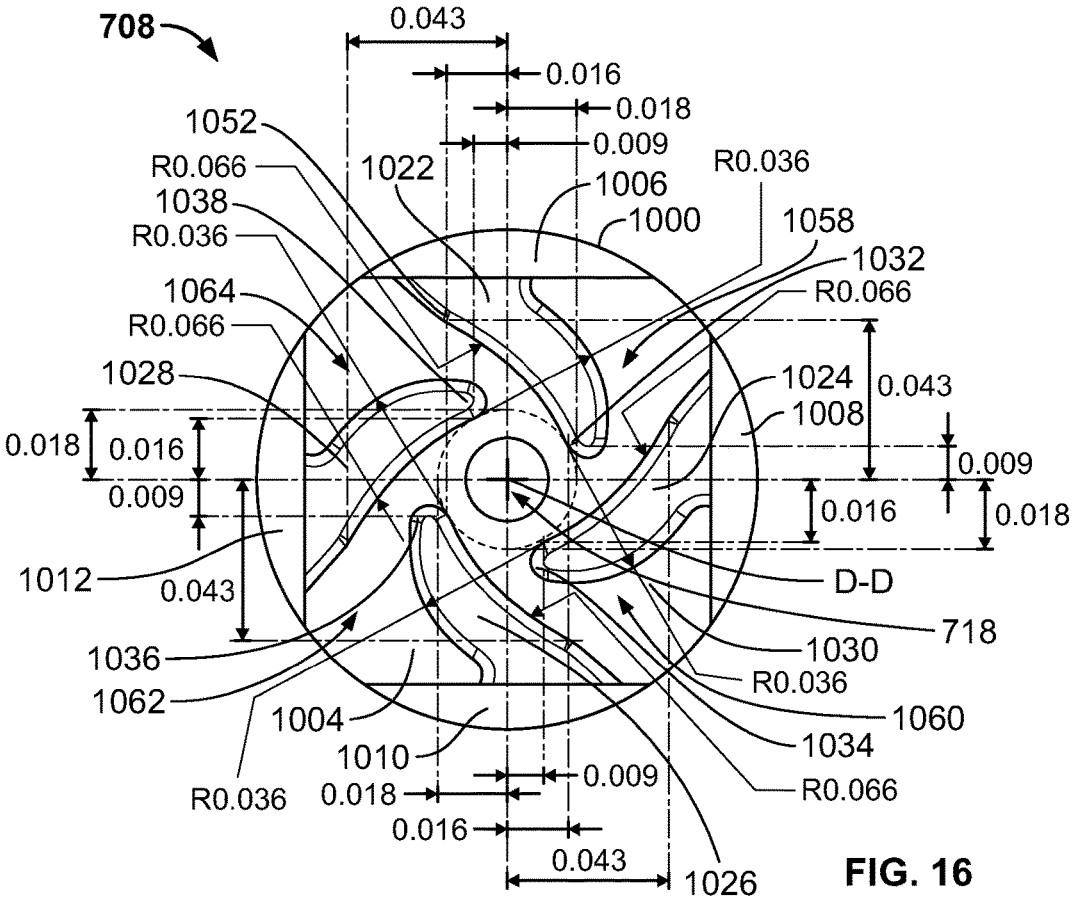
FIG. 16 is a schematic illustration of one embodiment of the spray insert of FIG. 10 with example dimensions that may be used.
Figure 17:
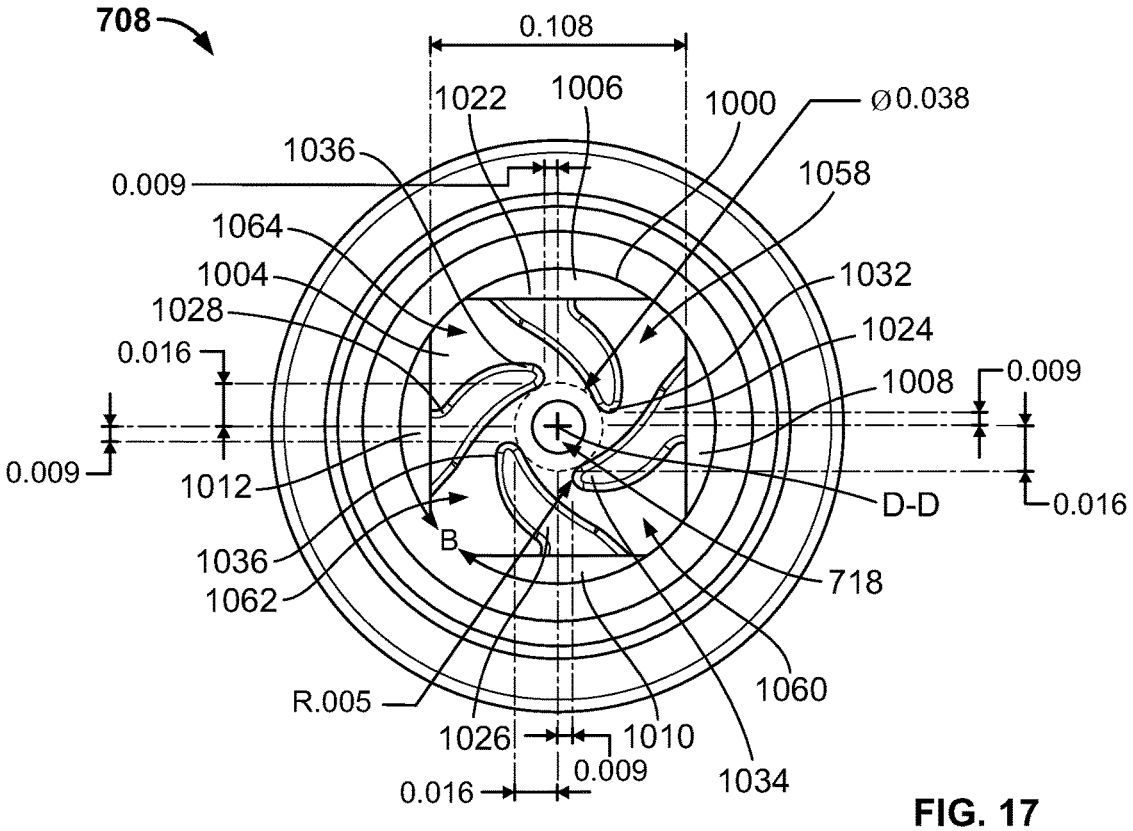
FIG. 17 is another schematic illustration of an embodiment of the spray insert of FIG. 10 with example dimensions that may be used.
Figure 18:
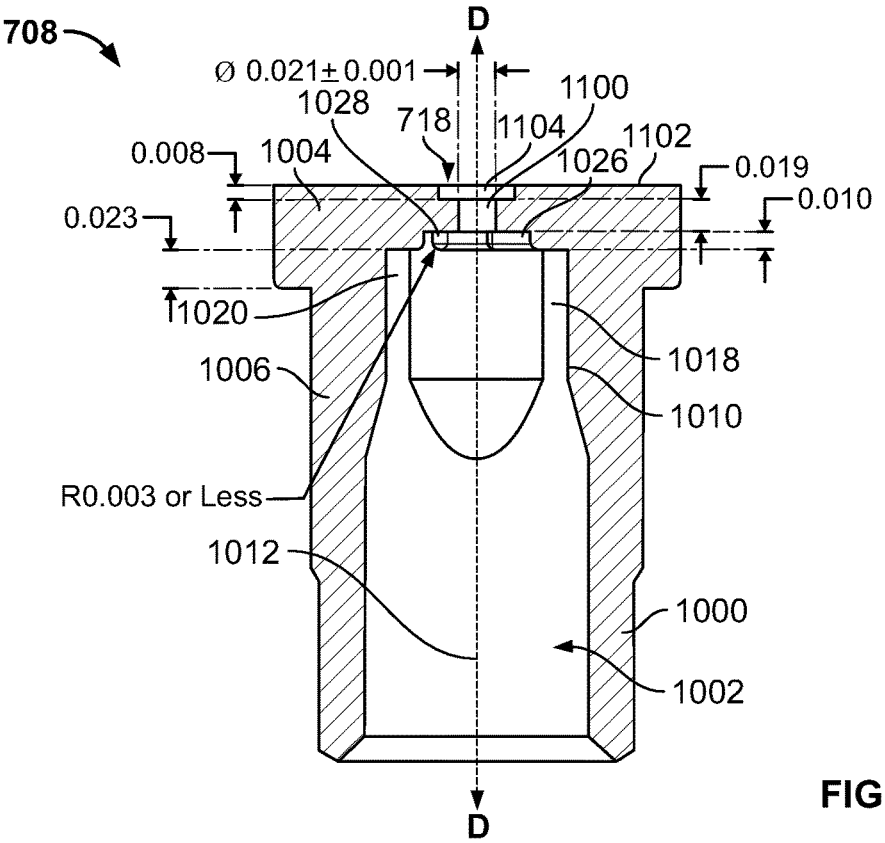
FIG. 18 is a schematic, elevational view of another embodiment of the spray insert of FIG. 10 with example dimensions that may be used.

FIGS. 16-18 illustrate exemplary dimensions that may be used to implement the spray insert 708 disclosed herein. For example, the swirl chamber 1040 has a diameter of about 0.038 inches. The swirl chamber 1040 has a height measured from the interior surface 1030 of the endwall 1004 to the distal end 910 of the post 904 when secured adjacent thereto of about 0.010 inches. The bore 1100 has a length of about 0.019 inches and a diameter of between 0.020 inches and 0.022 inches. The counterbore 1104 has a length of about 0.008 inches. A minimum distance between the first vane 1006 and the third vane 1010 is about 0.108 inches. A minimum distance between the second vane 1008 and the fourth vane 1012 is also about 0.108 inches. The first point of inflection 1052 of the first boss 1022 is a minimum distance of 0.047 inches from the central, longitudinal axis D-D of the spray insert 708. The above-noted dimensions are merely examples and, thus, other dimensions may be used without departing from the scope of this disclosure.

INDUSTRIAL APPLICABILITY

The examples disclosed herein can be used to dispense or discharge fluid products from commercial products such as, for example, air fresheners, pesticides, paints, deodorants, disinfectants, cleaning fluids, and/or one or more additional and/or alternative products.

Numerous modifications to the examples disclosed herein will be apparent to those skilled in the art in view of the foregoing description. Accordingly, this disclosure is to be construed as illustrative only and is presented for the purpose of enabling those skilled in the art to make and use the claimed invention and to teach the best mode of carrying out same. The exclusive rights to all modifications which come within the scope of the claims are reserved. All patents and publications are incorporated by reference.

What is claimed is:

1. A spray insert for use with an aerosol container, the spray insert comprising:

a sidewall;

an endwall including a discharge outlet extending through a planar interior surface thereof;

a first baffle disposed on the sidewall;

a second baffle disposed on the sidewall, the second baffle spaced apart from the first baffle to define a first longitudinal channel to direct a fluid product into a lateral channel; and a first boss disposed on the planar interior surface of the endwall and extending from the first baffle to define a portion of the lateral channel, the first boss having a tip spaced apart from the discharge outlet, wherein the first boss includes an airfoil-shaped portion to direct the fluid product in the lateral channel into a swirl chamber.

2. The spray insert of claim 1, wherein the first boss includes a base portion extending from the first baffle to the airfoil-shaped portion, wherein the base portion and the airfoil-shaped portion form a point of inflection.

3. The spray insert of claim 1, wherein the tip of the first boss is rounded.

4. The spray insert of claim 1, wherein a span of the lateral channel decreases from the sidewall toward the swirl chamber.

5. The spray insert of claim 1, wherein the airfoil-shaped portion is to direct the fluid product to rotate about a longitudinal axis of the spray insert when the fluid product is upstream of the swirl chamber.

6. The spray insert of claim 1, wherein the airfoil-shaped portion has a first side portion and a second side portion, the first side portion curved about a first axis of curvature, the second side portion curved about a second axis of curvature offset from the first axis of curvature in two perpendicular directions.

7. A spray insert, comprising:

a sidewall;

an endwall including a discharge outlet;

a first baffle disposed on the sidewall; and a first boss disposed on the endwall to direct fluid product into a swirl chamber, the first boss extending from the first baffle, the first boss including a rounded tip, a first side portion, and a second side portion opposite the first side portion, wherein the first side portion has a first radius of curvature and a first arc length, and the second side portion has a second radius of curvature and a second arc length, and wherein the first radius of curvature is greater than the second radius of curvature, and the first arc length is longer than the second arc length.

8. The spray insert of claim 7, wherein the first side portion is to direct the fluid product into the swirl chamber, the first side portion forming a first point of inflection with a third side portion of the first boss.

9. The spray insert of claim 8, wherein the third side portion extends from the first baffle to the first side portion.

10. The spray insert of claim 8, wherein the second side portion forms a second point of inflection with a fourth side portion of the first boss.

11. The spray insert of claim 9, wherein the fourth side portion extends from the first baffle to the second side portion.

12. The spray insert of claim 7, further comprising a second baffle disposed on the sidewall, the second baffle spaced apart from the first baffle to define a first longitudinal channel.

13. The spray insert of claim 12, wherein the first longitudinal channel extends substantially parallel to a longitudinal axis of the spray insert to direct the fluid product into an oblique channel defined by the first boss and a second boss disposed on the endwall.

14. The spray insert of claim 7, wherein the tip is spaced apart from the discharge outlet.

15. The spray insert of claim 7, wherein the spray insert is to discharge a sheet of the fluid product that includes an air core via the discharge outlet.

16. A spray insert for use with an aerosol container, the spray insert comprising:

a sidewall;

a first vane extending from the sidewall;

an endwall including a discharge outlet; and a first boss including a tip, a first side to direct a fluid product toward a swirl chamber, and a second side opposite the first side, the boss disposed on the endwall and extending from the vane, wherein at least one of the first side and the second side has a point of inflection, and wherein the first side and second side are curved and extend to the tip.

17. The spray insert of claim 16, further comprising:

a second vane extending from the sidewall and spaced apart from the first vane to define a longitudinal channel; and a second boss disposed on the endwall, extending from the second vane, and spaced apart from the first boss to define an oblique channel.

18. The spray insert of claim 17, wherein the oblique channel decreases in width from the sidewall toward the swirl chamber.

19. The spray insert of claim 16, wherein the spray insert is to discharge a substantially conical sheet of the fluid product via the discharge outlet.

20. The spray insert of claim 16, wherein the tip of the boss is rounded.

* * * * *